US007830370B2

(12) United States Patent
Yamazaki et al.

(10) Patent No.: US 7,830,370 B2
(45) Date of Patent: Nov. 9, 2010

(54) DISPLAY DEVICE AND METHOD OF MANUFACTURING THE SAME

(75) Inventors: Shunpei Yamazaki, Tokyo (JP); Yasuyuki Arai, Kanagawa (JP); Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 807 days.

(21) Appl. No.: 11/294,984

(22) Filed: Dec. 6, 2005

(65) Prior Publication Data

US 2006/0082568 A1 Apr. 20, 2006

Related U.S. Application Data

(62) Division of application No. 09/873,832, filed on Jun. 4, 2001, now Pat. No. 6,995,753.

(30) Foreign Application Priority Data

Jun. 6, 2000 (JP) ..... 2000-168330

(51) Int. Cl.
*G09G 5/00* (2006.01)

(52) U.S. Cl. ..... 345/207; 345/92; 345/204; 349/42; 349/47

(58) Field of Classification Search ..... 345/76, 345/77, 82, 83, 92, 204–207; 349/42–47, 349/116, 149, 187
See application file for complete search history.

(56) References Cited

U.S. PATENT DOCUMENTS 4,356,429 A 10/1982 Tang ..... 313/503
4,539,507 A 9/1985 VanSlyke et al. ..... 313/504
4,655,552 A * 4/1987 Togashi et al. ..... 349/24
4,720,432 A 1/1988 VanSlyke et al. ..... 428/457

(Continued)

FOREIGN PATENT DOCUMENTS

EP 0 604 006 A2 6/1994

(Continued)

OTHER PUBLICATIONS

Huang, T.Y. et al, "A New Stack Capacitor for Polysilicon Active Matrix Arrays," IEDM 89, pp. 357-360 (1989).

(Continued)

*Primary Examiner*—Richard Hjerpe
*Assistant Examiner*—Jennifer T Nguyen
(74) *Attorney, Agent, or Firm*—Husch Blackwell LLP Welsh Katz

(57) ABSTRACT

There is provided a display device capable of automatically controlling a luminance in response to a brightness of a surrounding. The display device has a gamma correction circuit for converting an image signal voltage into a drive voltage for gray scale display and a photosensor for controlling an input and output voltage characteristic of the gamma correction circuit in response to the brightness of the surrounding. In this case, the gamma correction circuit for converting the image signal voltage into the driver voltage for gray scale display is formed on a first substrate. The photosensor for controlling the input and output voltage characteristic of the gamma correction circuit in response to the brightness of the surrounding is formed on a second substrate. The second substrate is fixed to the first substrate.

13 Claims, 15 Drawing Sheets

U.S. PATENT DOCUMENTS

| | | | | |
|---|---|---|---|---|
| 4,760,389 | A | 7/1988 | Aoki et al. | 340/719 |
| 4,769,292 | A | 9/1988 | Tang et al. | 428/690 |
| 4,831,429 | A * | 5/1989 | Nakashima et al. | 257/55 |
| 4,885,211 | A | 12/1989 | Tang et al. | 428/457 |
| 4,950,950 | A | 8/1990 | Perry et al. | 313/504 |
| 5,047,687 | A | 9/1991 | VanSlyke | 313/503 |
| 5,059,861 | A | 10/1991 | Littman et al. | 313/503 |
| 5,059,862 | A | 10/1991 | VanSlyke et al. | 313/503 |
| 5,061,617 | A | 10/1991 | Maskasky | 430/569 |
| 5,073,446 | A | 12/1991 | Scozzafava et al. | 428/323 |
| 5,151,629 | A | 9/1992 | VanSlyke | 313/504 |
| 5,294,869 | A | 3/1994 | Tang et al. | 313/504 |
| 5,294,870 | A | 3/1994 | Tang et al. | 313/504 |
| 5,302,966 | A | 4/1994 | Stewart | 345/76 |
| 5,406,305 | A | 4/1995 | Shimomura et al. | 345/102 |
| 5,465,053 | A * | 11/1995 | Edwards | 324/770 |
| 5,499,123 | A | 3/1996 | Mikoshiba | |
| 5,510,851 | A | 4/1996 | Foley et al. | 348/658 |
| 5,530,240 | A | 6/1996 | Larson et al. | 250/214 |
| 5,617,112 | A | 4/1997 | Yoshida et al. | 345/102 |
| 5,644,327 | A | 7/1997 | Onyskevych et al. | |
| 5,702,323 | A | 12/1997 | Poulton | 482/8 |
| 5,760,760 | A | 6/1998 | Helms | 345/102 |
| 5,831,693 | A * | 11/1998 | McCartney et al. | 349/42 |
| 5,839,456 | A | 11/1998 | Han | 134/104.1 |
| 5,880,705 | A | 3/1999 | Onyskevych et al. | |
| 5,956,015 | A | 9/1999 | Hino | 345/600 |
| 5,962,962 | A | 10/1999 | Fujita et al. | 313/412 |
| 5,990,629 | A | 11/1999 | Yamada et al. | 315/169.3 |
| 6,005,350 | A | 12/1999 | Hachiya et al. | 315/156 |
| 6,050,717 | A | 4/2000 | Kosugi et al. | 364/146 |
| 6,069,598 | A | 5/2000 | Hansen | |
| 6,243,069 | B1 | 6/2001 | Ogawa et al. | 345/102 |
| 6,262,767 | B1 | 7/2001 | Wakui | 348/211.99 |
| 6,265,833 | B1 | 7/2001 | Kim et al. | 315/169.3 |
| 6,297,791 | B1 | 10/2001 | Naito et al. | 345/89 |
| 6,337,675 | B1 | 1/2002 | Toffolo et al. | 345/77 |
| 6,388,678 | B1 | 5/2002 | Kasahara et al. | |
| 6,392,617 | B1 | 5/2002 | Gleason | 345/82 |
| 6,417,825 | B1 | 7/2002 | Stewart et al. | 345/77 |
| 6,424,326 | B2 | 7/2002 | Yamazaki et al. | 345/77 |
| 6,448,663 | B1 * | 9/2002 | Uchiyama | 257/778 |
| 6,462,722 | B1 | 10/2002 | Kimura et al. | 345/76 |
| 6,466,334 | B1 | 10/2002 | Komiya et al. | 358/1.9 |
| 6,479,940 | B1 | 11/2002 | Ishizuka | 315/169.3 |
| 6,483,484 | B1 | 11/2002 | Yamazaki et al. | 345/8 |
| 6,518,962 | B2 * | 2/2003 | Kimura et al. | 345/211 |
| 6,528,951 | B2 | 3/2003 | Yamazaki et al. | 315/169.3 |
| 6,535,207 | B1 | 3/2003 | Hiroki | 345/207 |
| 6,628,258 | B1 * | 9/2003 | Nakamura | 345/98 |
| 6,639,589 | B1 * | 10/2003 | Kim et al. | 345/206 |
| 6,828,951 | B2 | 12/2004 | Yamazaki et al. | 345/77 |
| 6,888,528 | B2 | 5/2005 | Rai et al. | |
| 7,068,246 | B2 | 6/2006 | Yamazaki et al. | |
| 2001/0035848 | A1 | 11/2001 | Johnson et al. | 345/76 |
| 2002/0011978 | A1 | 1/2002 | Yamazaki et al. | 345/87 |
| 2002/0033783 | A1 | 3/2002 | Koyama | 345/82 |
| 2002/0044208 | A1 | 4/2002 | Yamazaki et al. | 348/272 |
| 2002/0047550 | A1 | 4/2002 | Tanada | 315/155 |
| 2002/0050974 | A1 | 5/2002 | Rai et al. | |
| 2002/0180672 | A1 | 12/2002 | Yamazaki et al. | 345/77 |
| 2002/0196206 | A1 | 12/2002 | Kimura et al. | 345/44 |
| 2003/0063044 | A1 | 4/2003 | Yamazaki et al. | 345/8 |
| 2003/0132716 | A1 | 7/2003 | Yamazaki et al. | 315/169.3 |
| 2003/0231273 | A1 | 12/2003 | Kimura et al. | 349/139 |
| 2006/0132401 | A1 | 6/2006 | Yamazaki et al. | |

FOREIGN PATENT DOCUMENTS

| | | |
|---|---|---|
| EP | 0 717 445 | 6/1996 |
| EP | 0 917 127 A1 | 5/1999 |
| EP | 0 604 006 B1 | 1/2000 |
| EP | 1 337 131 A2 | 8/2003 |
| EP | 1 363 265 A2 | 11/2003 |
| JP | 4-326849 | 11/1992 |
| JP | 5-88655 | 4/1993 |
| JP | 05-241512 | 9/1993 |
| JP | 6-138484 | 5/1994 |
| JP | 08-078159 | 3/1996 |
| JP | 08-241048 | 9/1996 |
| JP | 9-81070 | 3/1997 |
| JP | 9-146073 | 6/1997 |
| JP | 09-304730 | 11/1997 |
| JP | 10-189252 | 7/1998 |
| JP | 10-189525 | 7/1998 |
| JP | 11-121760 | 4/1999 |
| JP | 11-326954 | 11/1999 |
| JP | 2000-12215 | 1/2000 |
| JP | 2000-81608 | 3/2000 |
| JP | 2000-235366 | 8/2000 |
| JP | 2001-35655 | 2/2001 |
| KR | 99-22274 | 3/1999 |
| KR | 99-49744 | 7/1999 |
| TW | 382687 | 2/2000 |
| WO | WO 93/23972 A1 | 11/1993 |
| WO | WO 96/41327 A1 | 12/1996 |
| WO | WO 98/09433 | 3/1998 |
| WO | WO 99/12148 A1 | 3/1999 |
| WO | WO 99/30308 A1 | 6/1999 |
| WO | WO 99/40559 | 8/1999 |
| WO | WO 99/53472 A1 | 10/1999 |

OTHER PUBLICATIONS

U.S. Appl. No. 09/752,817 (pending) to Yamazaki et al., including PTO filing receipt, specification, claims, abstract, and drawings, Jan. 3, 2001.

U.S. Appl. No. 09/753,708 (pending) to Yamazaki et al., including PTO filing receipt, specification, claims, abstract, and drawings, Jan. 4, 2001.

U.S. Appl. No. 09/924,610 (pending) to Koyama including PTO filing receipt, specification, claims, abstract, and drawings, Aug. 9, 2001.

* cited by examiner

DISPLAY DEVICE AND METHOD OF MANUFACTURING THE SAME

This application is a divisional of U.S. application Ser. No. 09/873,832 filed Jun. 4, 2001 now U.S. Pat. No. 6,995,753.

BACKGROUND OF THE INVENTION

1. Field of the Invention

The present invention relates to a display device in which the luminance of a display screen can be controlled in response to the brightness of a surrounding and a method of manufacturing the same.

2. Description of the Related Art

A technique for forming a thin film transistor (hereinafter referred to as a TFT) on a substrate is greatly improved, and thus the application to an active matrix display device is progressing. Conventionally, the active matrix display device utilized by TFTs using an amorphous silicon film requires a driver IC. However, TFTs using a polycrystalline silicon film can be operated with a high driver frequency, and TFTs in a pixel portion and TFTs in a driver circuit can be integrally formed on a substrate.

The active matrix display device in which the driver circuit is integrally formed on the substrate has gathered attention, because various advantages such as a cost reduction, a miniaturization of the device, and an improvement of a production yield are obtained in the case where various circuits such as a shift register and a sampling circuit are formed.

In the active matrix display device, TFTs are arranged in several tens to several millions of pixels, and a separate electrode (pixel electrode) is provided with respective TFTs. In the case of a liquid crystal display device, liquid crystal is filled between an element substrate in which the TFTs are formed and a counter substrate in which a common electrode is formed. A capacitor using the liquid crystal located between the separate electrode and the common electrode as dielectric is formed. The operation of the liquid crystal display device is as follows. That is, a voltage applied to the respective pixels is controlled by a switching function of the TFT and charges are stored in the capacitor to drive the liquid crystal. Then, an amount of light transmitted through the liquid crystal is controlled to display an image. Although there is the reflection type liquid crystal display device using external light, the liquid crystal display device with a backlight unit or a front light unit as a light source is generally used.

On the other hand, a display device in which a light emitting element is provided for respective pixels and turning of or off of the light emitting element is controlled by the TFT to display an image is developed. In this device, the light emitting element utilizes electro luminescence (hereinafter is referred to as EL). Thus, such a display device is also called an EL display device. In an active matrix EL display device using the TFTs, a TFT for switching (hereinafter is referred to as a switching TFT) is provided for respective pixels. A TFT for current control (hereinafter is referred to as a current control TFT) is operated by the switching TFT to make an EL layer (corresponding to organic compound layer including a light emitting layer) emit light. There is the EL display device described in, for example. Japanese Patent Application Laid-open No. Hei 10-189252.

Thus, even in the cases of using external light and using light by self light emitting, the active matrix display device controls a luminance of a screen with the TFTs in accordance with an input voltage based on an image signal, to display an image.

However, in many conventional display devices, an input voltage characteristic for image display is fixed, and thus sufficient attention is not paid such that a maximum luminance required for the display device is changed in response to a surrounding. In the case where the surrounding is nighttime and dark, even if the same luminance as in the case where the device is used outdoors in day is not obtained, an image to be displayed can be recognized. However, in this case, the luminance is not controlled. Thus, a user will see a glare and visibility is deteriorated in many cases.

Of course, a method of detecting the brightness of the surrounding by a sensor and then controlling the luminance of the screen is proposed. As a sensor for detecting the brightness, that is, the illuminance, a photodiode, a phototransistor, or the like is used. However, when those sensors are mounted as separate parts on the display device, a further area is required for the sensors. The external light is scattered by objects around the display device and incident into the photosensor with various angles. As a result, there is a problem that a difference is produced between the brightness of the surrounding and the luminance correction.

Also, there is a problem that, although dependent on a kind of sensor, if an optical filter is not attached to the display device in order to fit a spectral sensitive characteristic of a sensor to a luminosity of a person, an error in the correction is produced. For example, spectral sensitivity of a sensor using single crystalline silicon is extended to an infrared light region. Thus, in order to correct the brightness with accuracy, it is necessary to provide a visual sensitivity correction filter. Therefore, an enlargement of the display device cannot be prevented.

SUMMARY OF THE INVENTION

In order to solve the above problems, an object of the present invention is therefore to realize a display device in which the luminance can be automatically controlled in response to the brightness of the surrounding, and the luminance can be suitably controlled in accordance with a change in the brightness of the surrounding that the human senses.

To solve the above problems, according to a structure of the present invention, in an active matrix display device, an output line of a gamma correction circuit is connected with an image signal processing circuit. The gamma correction circuit outputs a signal for changing an apparent luminance of a pixel in response to a brightness of a surrounding based on an output signal from photosensor, to the image signal processing circuit. A plurality of photosensors are provided. The plurality of photosensors are provided around a pixel portion in the active matrix display device. Thus, when the intensities of lights incident to respective photosensors with various angles due to scattering by ambient objects are detected and the intensities of the respective photosensors are balanced, a suitable correction can be made. Incidentally, other correction circuit than the gamma correction circuit can be used.

In this case, the following structure is desirable. That is, the gamma correction circuit for converting an image signal voltage into a driver voltage for a gray scale display is formed in a first substrate. The photosensors for controlling an input and output voltage characteristic of the gamma correction circuit in response to the brightness of the surrounding are formed in a second substrate. The second substrate is fixed to the first substrate.

Also, another structure of the present invention has a plurality of photosensors provided in an outer portion of a substrate; a source follower circuit connected with the plurality of photosensors; a gamma correction circuit connected with the source follower circuit; an image signal amplifying circuit connected with the gamma correction circuit; a source signal line driver circuit connected with the image signal amplifying circuit; and a pixel portion which is connected with the source signal line driver circuit and formed in the substrate. As the photosensor used in the present invention, the photosensor including an amorphous silicon layer in a photoelectric conversion layer are preferably applied.

In the photoelectric conversion layer of the photosensor, an I-type amorphous silicon film with a high resistance is sandwiched between p-type and n-type amorphous semiconductor films or p-type and n-type microcrystalline semiconductor films. Also, the photosensor has a structure in that a transparent electrode is formed in a light incident side and a metal electrode is formed in its opposite side. The photosensor with such a structure has a peak between 500 to 600 nm in a spectral sensitive characteristic. This characteristic is close to the characteristic of a luminosity of a person. Therefore, a luminosity correction filter may not be used.

Also, another structure of the present invention is characterized by comprising the steps of: forming a pixel portion using a thin film transistor on a first substrate; forming a photosensor on a second substrate; and fixing the second substrate to the first substrate.

Also, another structure of the present invention is characterized by comprising the steps of: forming a pixel portion, a driver circuit for driving the pixel portion, and a control circuit for controlling a luminance of the pixel portion, using a thin film transistor, on a first substrate; forming a photosensor on a second substrate; and fixing the second substrate to the first substrate to electrically connect the control circuit with the photosensor.

The microcrystalline semiconductor film or the amorphous silicon film, composing the photosensor, and a conductive film for forming an electrode can be formed by a plasma CVD method or a sputtering method. Even if an area of the substrate is enlarged, a film can be formed by these film formation methods. For example, a substrate having one side length of 300 mm or longer in size, preferably, 1000 mm or longer can be used. On the other hand, with respect to a size of the photosensor mounted in the display device, one side length is 1 to 5 mm. Thus, when a large size substrate is used, a large number of photosensors can be obtained from one substrate.

DETAILED DESCRIPTION OF THE PREFERRED EMBODIMENTS

Figure 1:
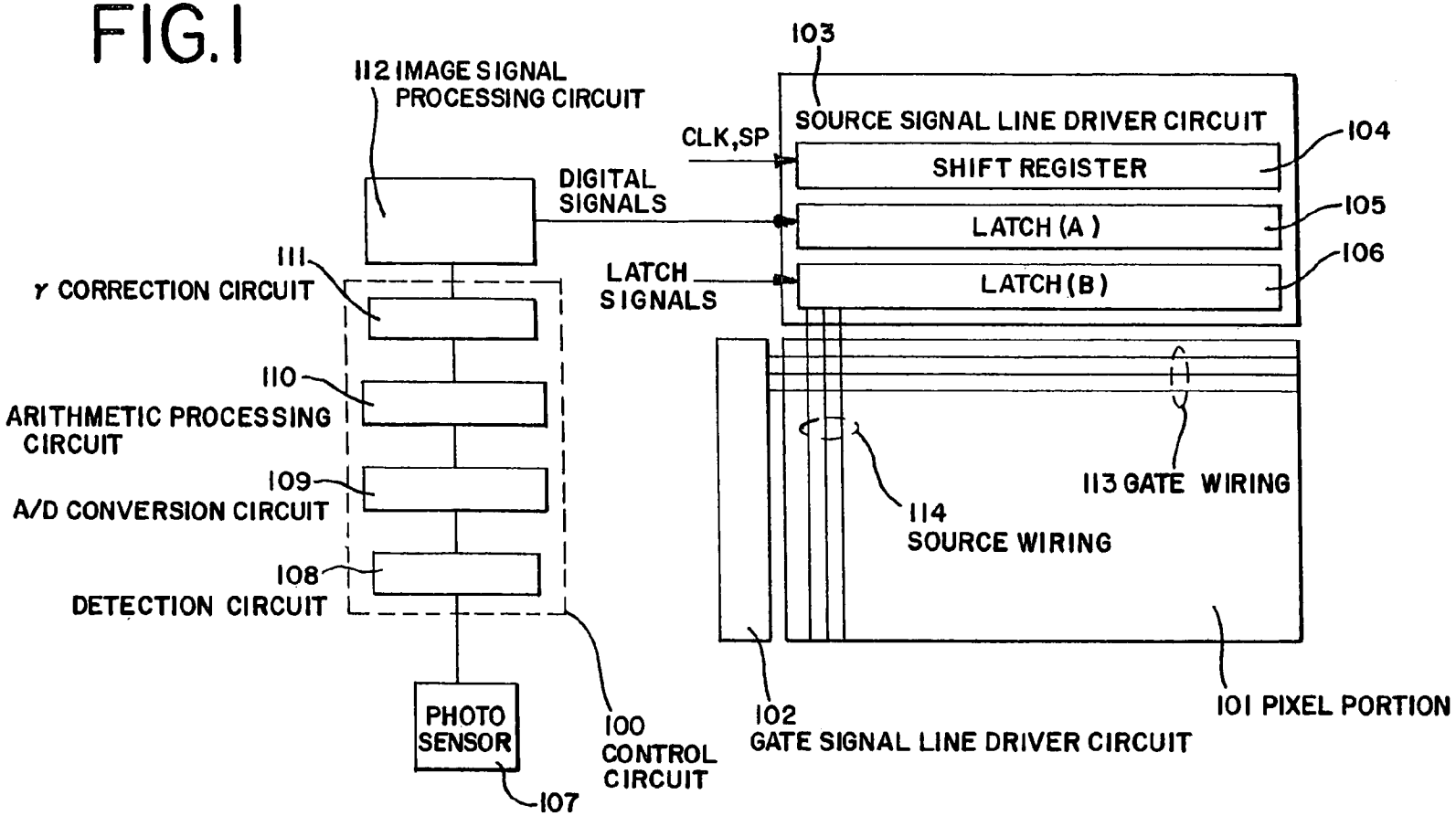
FIG. 1 is an explanatory view of a structure of a digital drive display device according to the present invention.

FIG. 1 is a block diagram of a circuit structure of an active matrix display device of a digital drive system. In a pixel portion 101, a plurality of gate lines 113 extended from a gate signal line driver circuit 102 and a plurality of source lines 114 extended from a source signal line driver circuit 103 are formed so as to intersect them each other, and thus the TFT are formed in respective intersections. This display device has an image signal processing circuit 112 for forming a digital data signal inputted to the pixel portion 101.

A control circuit 100 for detecting the brightness of a surrounding and then controlling the amplitude of an image signal inputted to the pixel portion, is constructed by a detection circuit 108 for detecting an output of the photosensor 107, an A/D conversion circuit 109, an arithmetic processing circuit 110, and a gamma correction circuit 111.

With respect to the photosensor 107, a structure having a pin junction that an I-type amorphous silicon film with a high resistance is sandwiched between p-type and n-type amorphous semiconductor films or microcrystalline semiconductor films, as a photoelectric conversion layer, is used. In this structure, a transparent electrode is formed in a light incident side and a metal electrode is formed in its opposite side. Thus, the photosensor using the amorphous silicon film has a peak between 500 to 600 nm in a spectral sensitive characteristic. This characteristic is approximate to the characteristic of a luminosity of a person. Therefore, a luminous correction filter may not be used.

Figure 2:
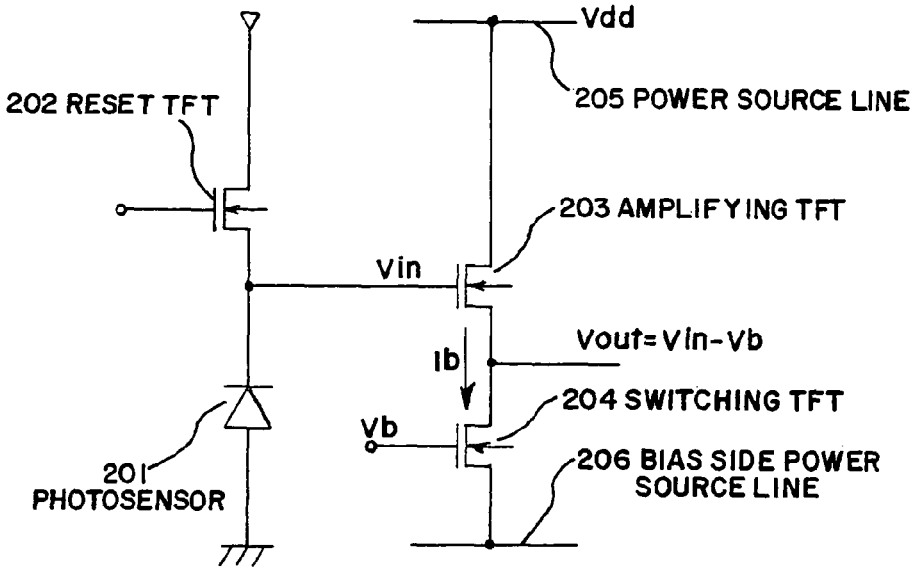
FIG. 2 is a diagram of a source follower circuit for reading an output of a photosensor.

FIG. 2 is an explanatory circuit diagram of the detection circuit 108. When a reset TFT 202 is in a conduction state, a reverse bias voltage is applied to a photosensor 201. (Hereinafter, a charging operation that a potential of a minus (–) side terminal of the photosensor 201 reaches that corresponding to a power source voltage is called reset.) After that, the reset TFT 202 is made to be a nonconduction state. At this time, by an electromotive force of the photosensor 201, as time elapses, the potential of the minus (−) side terminal of the photosensor 201 charged in the potential corresponding to the power source voltage is gradually decreased by charges produced by a photoelectric conversion. After a constant time is elapsed, when a switching TFT 204 is made to be a conduction state, a signal is outputted to an output side through an amplifying TFT 203.

In this case, the amplifying TFT 203 and the switching TFT 204 operate as a so-called source follower circuit. In FIG. 2, an example that the source follower circuit is formed using an n-channel TFT is shown. However, the source follower circuit can be formed using a p-channel TFT. A power source voltage Vdd is applied to an amplification side power source line 205. A standard potential 0 V is provided to a bias side power source line 206. A drain side terminal of the amplifying TFT 203 is connected with the amplification side power source line 205, and a source side terminal thereof is connected with a drain terminal of the switching TFT 204. The source side terminal of the switching TFT 204 is connected with the bias side power source line 206. A bias voltage Vb is applied to a gate terminal of the switching TFT 204, and thus a bias current Ib flows into this TFT. The switching TFT 204 basically operates as a constant current source. An input voltage Vin is applied to a gate terminal of the amplifying TFT 203, and thus the source terminal thereof becomes an output terminal. An input and output relation of this source follower circuit is given by, Vout=Vin−Vb.

This output voltage Vout is converted into a digital signal by the A/D conversion circuit 109. The digital signal is converted into a correction signal for correcting the luminance of an image based on preset comparison data with respect to a signal inputted to the arithmetic processing circuit 110. The gamma correction circuit 111 generates a correction voltage based on this correction signal, and its output line is connected with the image signal processing circuit 112 to output the correction voltage.

The image signal processing circuit 112 converts an video signal (signal including image information) made from an analog signal or a digital signal into a digital data signal for a time division gray scale and generates a timing pulse or the like, required for the time division gray scale display. Thus, the digital data signal is inputted to a source signal line driver circuit.

The image signal processing circuit 112 includes a time division gray scale data signal generating circuit. This generating circuit includes means for dividing one frame period into a plurality of subframe periods corresponding to n-bit (n is an integer larger than two) gray scales, means for selecting address periods and sustain periods in the plurality of subframe periods, and means for setting the sustain periods so as to Ts1:Ts2:Ts3: . . . :Ts(n−1):Ts(n)=$2^0$: $2^{-1}$:$2^{-2}$: . . . :$2^{-(n-2)}$: $2^{-(n-1)}$.

Figure 20:
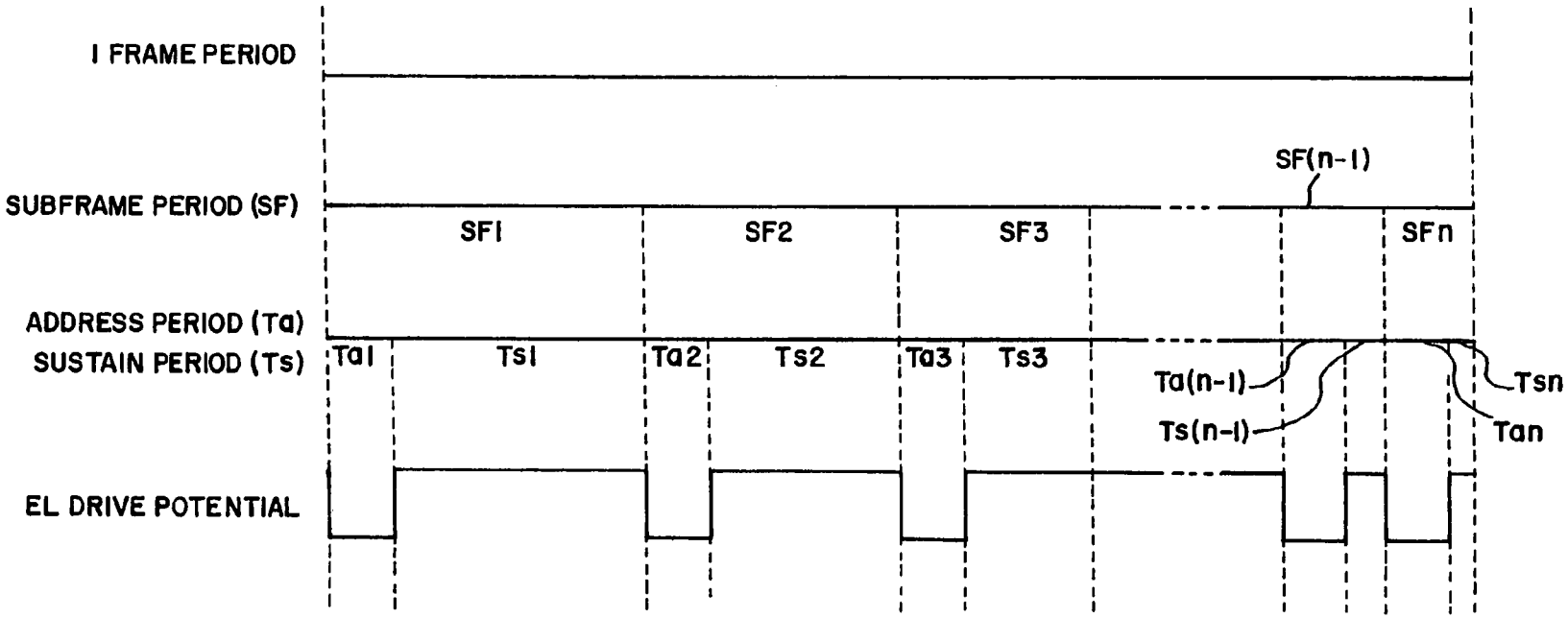
FIG. 20 shows an operation by a time division gray scale method.

Next, the time division gray scale display will be described using FIG. 20. Here, the case where a full color display with $2^n$ gray scales is performed by an n-bit digital driver system will be described. First, as shown in FIG. 20, one frame period is divided into n-subframe periods (SF1 to SFn). Note that, a period that one image is displayed by all pixels in the pixel portion is called one frame period. With respect to the frame period, an oscillating frequency is 60 Hz or higher, that is, 60 or more per one second are provided and thus 60 images or more per one second are displayed. When the number of images to be displayed per one second is less than 60, an image flicker or the like visually becomes remarkable. In addition, each period in the case where one frame period is divided into a plurality of periods is called a subframe period. As the number of gray scales is increased, the number of divisions for one frame period is also increased. Thus, a driver circuit must drive with a high frequency.

One subframe period is divided into the address periods (Ta) and the sustain periods (Ts). The address period is a time required for inputting data to all pixels during one subframe period. The sustain period represents a period that the pixel is in an on-state (bright state).

The lengths of all address periods (Ta1 to Tan) included in n-respective subframe periods (SF1 to SFn) are constant. The respective sustain periods (Ts) included in the subframe period SF1 to SFn are given as Ts1 to Tsn. The lengths of the sustain periods are set so as to Ts1:Ts2:Ts3: . . . :Ts(n−1): Tsn=$2^0$:$2^{-1}$:$2^{-2}$: . . . :$2^{-(n-2)}$:$2^{-(n-1)}$. Note that an occurrence order of SF1 to SFn may be arbitrary. By a combination of sustain periods, a desired gray scale display of $2^n$ gray scales can be realized.

The sustain periods are determined based on the correction voltage from the gamma correction circuit 111, and thus the luminance of an image can be controlled in response to the brightness of a surrounding.

The source signal line driver circuit 103 has basically, a shift register 104, a latch A 105, and a latch B 106. Also, a clock pulse (CLK) and a start pulse (SP) are inputted to the shift register 104. Digital data signals are inputted to the latch A 105. Latch signals are inputted to the latch B 106. Note that, although only one source signal line driver circuit 103 is provided in FIG. 1, a plurality of source signal side driver circuits may be provided.

Also, the gate signal line driver circuit 102 has a shift register, buffers, and the like (these not shown). Note that, although a plurality of gate signal line driver circuits 302*a* and 302*b* are provided in FIG. 3, one gate signal side driver circuit may be provided in this embodiment.

Figure 15:
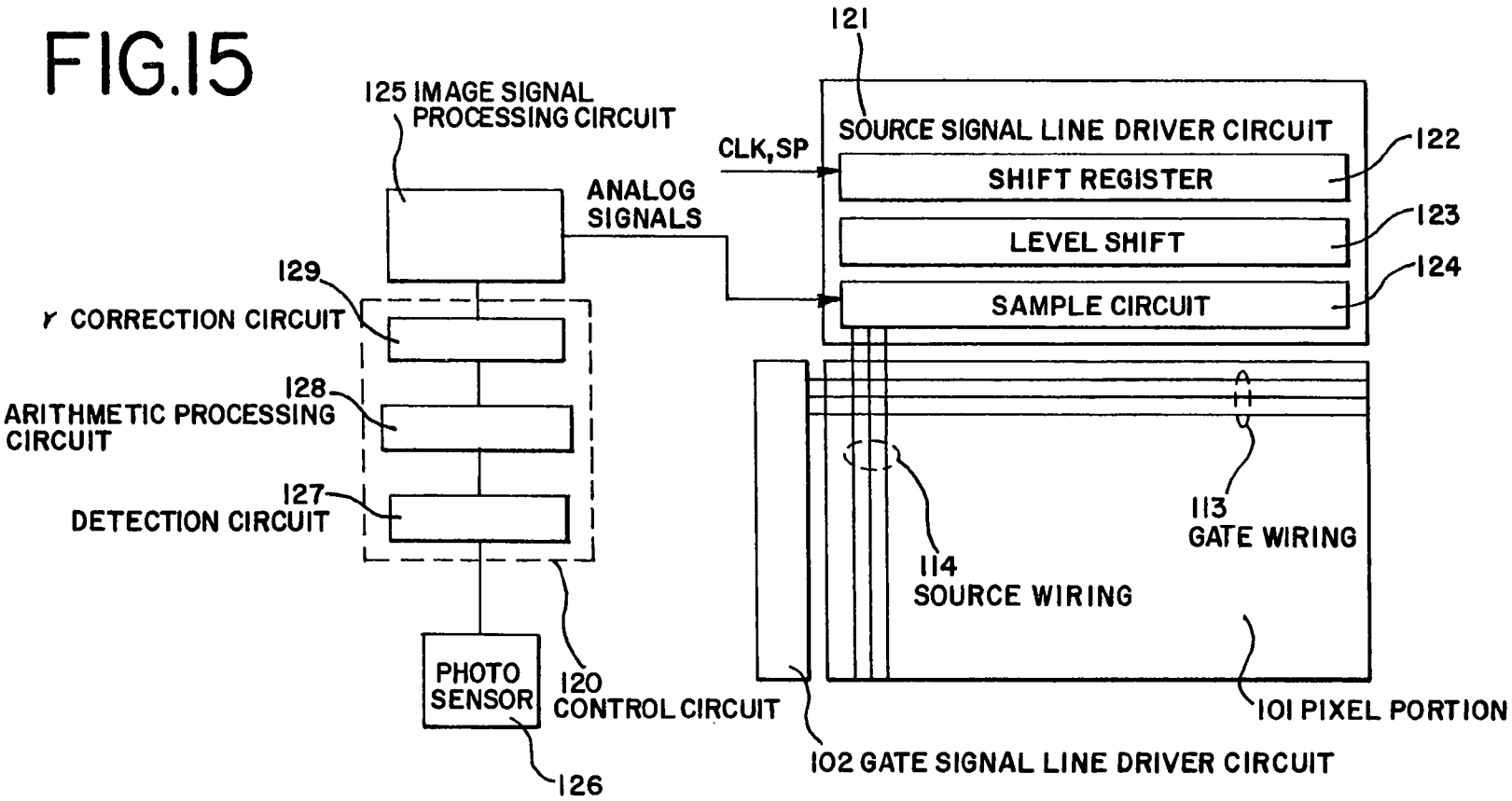
FIG. 15 is an explanatory view of a structure of an analog drive display device according to the present invention.

FIG. 15 is a block diagram representing a structure of an active matrix display device of an analog drive system. Reference numeral 121 denotes a source signal line driver circuit and 102 denotes a gate signal line driver circuit. In this embodiment, although one source signal line driver circuit and one gate signal line driver circuit are provided, the present invention is not limited to this structure. For example, two source signal line driver circuits may be provided. In addition, for example, two gate signal line driver circuits may be provided.

The source signal line driver circuit 121 has a shift register 122, a level shifter 123, and a sampling circuit 124. Note that the level shifter may be used if necessary and thus may be not necessarily used. In addition, in this embodiment, although the structure in that the level shifter is provided between the shift register 122 and the sampling circuit 124 is used, the present invention is not limited to this structure. The structure in that level shifter 123 is incorporated into the shift register 122 may be used.

The clock signal (CLK) and the start pulse signal (SP) are inputted to the shift register 122. A sampling signal for sampling a signal of analog (analog signal) is outputted from the shift register 122. The outputted sampling signal is inputted to the level shifter 123, and then outputted by increasing the amplitude of its potential. The sampling signal that is outputted from the level shifter 123 is inputted to the sampling circuit 124. An analog image display signal that is inputted to the sampling circuit 124 is sampled with the sampling signal and then inputted to the source signal lines.

A control circuit 120 for detecting the brightness of a surrounding and controlling the amplitude of an image signal inputted to the pixel portion is constructed by a photosensor 126, a detection circuit 127 for detecting an output from the photosensor 126, an arithmetic processing circuit 128, and a gamma correction circuit 129. Structures of the photosensor 126 and the detection circuit 127 are the same as in FIG. 2. The output voltage Vout of the detection circuit 127 is converted into a correction signal for correcting the luminance of an image with respect to a signal inputted to the arithmetic processing circuit 128. An image signal processing circuit 125 performs luminance control by changing the amplitude of an image signal based on the correction signal.

Thus, even if the active matrix display device of the analog drive system is used, a photosensor is attached thereto and the correction voltage is changed based on the brightness of the surrounding, which is detected by the photosensor, to make a voltage gray scale. Thus, the luminance can be controlled. Note that the structures of the pixel portion and the driver circuits which are shown here are one example and the present invention is not limited to the structure shown in this embodiment.

Embodiment 1

Figure 3:
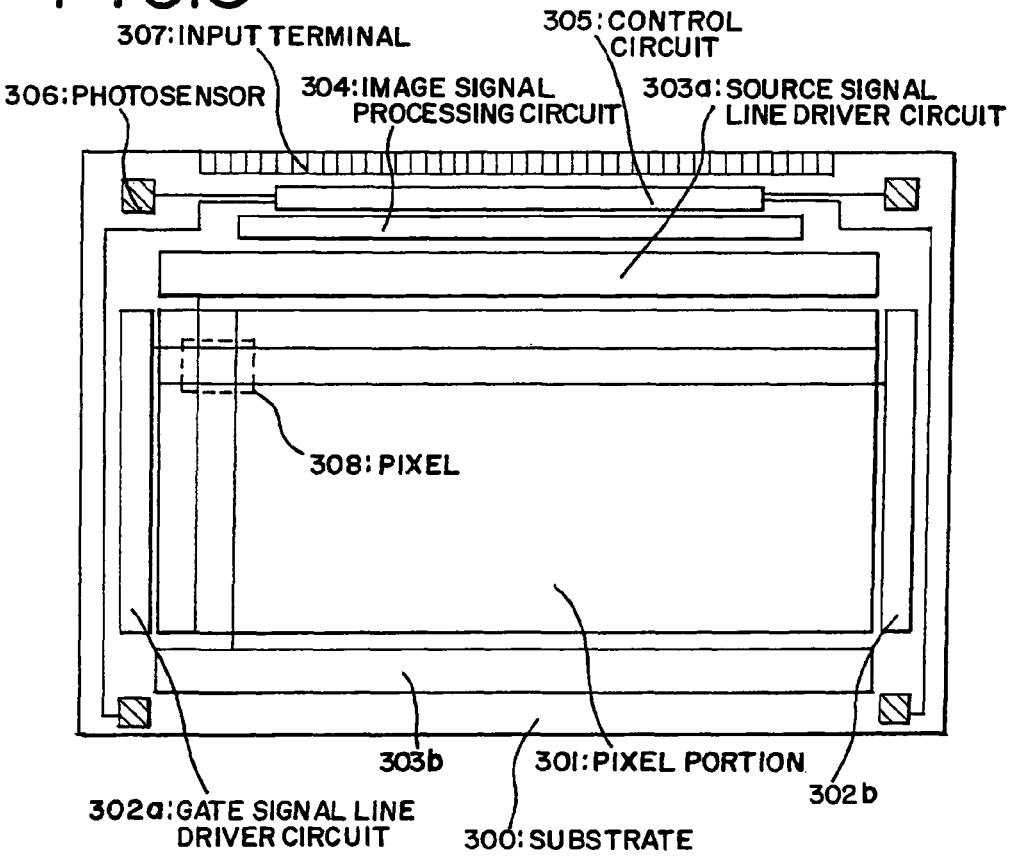
FIG. 3 is an explanatory view of a layout among the photosensor, a pixel portion, a driver circuit, and a control circuit.

FIG. 3 is a schematic view of an active matrix display device having an automatic luminance control function. A pixel portion 301, gate signal line driver circuits 302*a* and 302*b*, source signal line driver circuits 303*a* and 303*b*, a control circuit 305, an image signal processing circuit 304, input terminals 307, and photosensors 306 are provided on a substrate 300 having an insulating surface. As shown in FIG. 3, the plurality of photosensors 306 are provided in outer portions of the substrate 300. When the plurality of photosensors 306 are provided, lights with various angles are detected, and thus the luminance can be delicately controlled.

The photosensors 306 are manufactured using a material such as amorphous silicon having a photoelectric effect. The photosensors 306 are manufactured on another substrate and then attached onto the outer portions of the substrate 300 outside the pixel portion 301 and the driver circuits on the substrate 300. In this case, light receiving surfaces of the photosensors 306 and an image display surface of the pixel portion 301 are faced toward the same direction.

A plurality of pixels 308 are arranged in a matrix form in the pixel portion 301. The pixels 308 are formed with a different structure in accordance with a type of the display device. In any case, a TFT is provided in the respective pixels.

Structures of the image signal processing circuit 304 and the control circuit 305 are the same as in FIG. 1 (digital drive) or FIG. 15 (analog drive). The amplitudes of image signals inputted to the source signal line driver circuits are changed in response to the outputs from the photosensors 306 to make the brightness control. In the case where a surrounding is bright, the amplitude of the image signal is increased, and the luminance of the image is increased. On the other hand, in the case where the surrounding is dark, these are decreased.

The pixel portion 301, the gate signal line driver circuits 302*a* and 302*b*, the source signal line driver circuits 303*a* and 303*b*, the image signal processing circuit 304, and the control circuit 305 can be formed on the substrate 300 using the TFTs.

According to the present invention, in the active matrix display device, the brightness of the surrounding is detected by the photosensors and the luminance of the image display is controlled based on this information. The plurality of photosensors 306 are provided in the periphery of the pixel portion 301. Thus, when the intensities of lights incident to respective photosensors from various angles due to scattering by surrounding objects are detected and then the intensities of the respective photosensors are balanced, a suitable correction can be made. Note that, the present invention is not limited to the structure of the display device of FIG. 3. The structure of FIG. 3 is one of preferred embodiments for embodying the present invention.

Embodiment 2

The active matrix display device shown in FIG. 3 can be realized the liquid crystal display device and the EL display device. In this embodiment, the example of forming the TFT on the substrate and manufacturing the liquid crystal display device is explained.

Figure 4A:
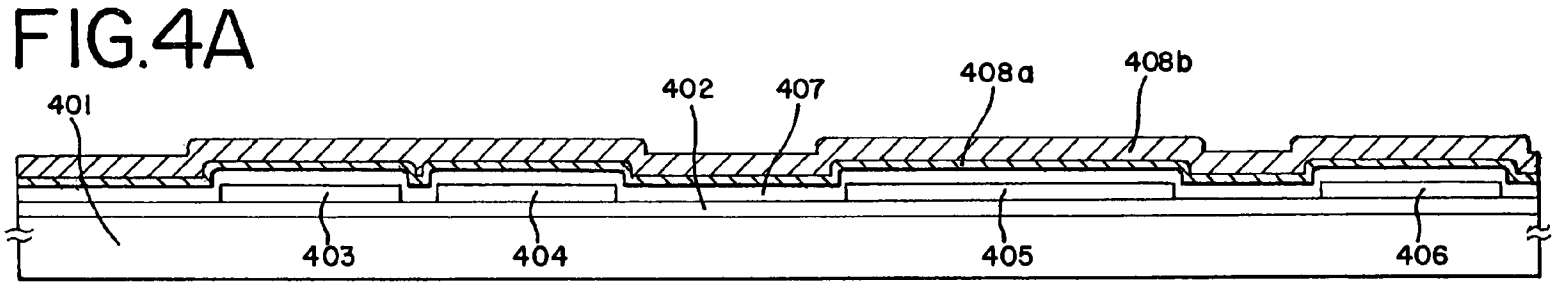
FIGS. 4A to 4C are cross sectional views explaining a manufacturing process for TFTs in the pixel portion and a peripheral circuit.

First, as shown in FIG. 4A, a blocking layer 402 is formed of an insulating film such as a silicon oxide film, a silicon nitride film, or a silicon oxynitride film on a glass substrate 401 made of barium borosilicate glass represented by such as #7059 glass or #1737 glass of Corning Inc., or alumino borosilicate glass. For example, a silicon oxynitride film with a thickness of 10 to 200 nm (preferably 50 to 100 nm) is manufactured by a plasma CVD method from $SiH_4$, $NH_3$, and $N_2O$, and a silicon hydride oxynitride film manufactured similarly from $SiH_4$ and $N_2O$ is laminated and formed with a thickness of 50 to 200 nm (preferably 100 to 150 nm). In this embodiment, the blocking layer 402 is shown as a two layer structure, but it may be formed as a single layer film or a lamination of two layers or more of the insulating films.

Semiconductor layers 403 to 406 divided into island shapes are formed of a semiconductor film with a crystal structure (herein below, referred to as crystalline semiconductor film) obtained by heat treatment of a semiconductor film with an amorphous structure using a laser annealing method or a furnace annealing oven. The island shape semiconductor layers 403 to 406 are formed with a thickness of 25 to 80 nm (preferably 30 to 60 nm). There is no limitation on the material of the crystalline semiconductor film, but preferably is formed of such as silicon or silicon germanium (SiGe) alloy.

In the case of manufacturing the crystalline semiconductor film by a laser annealing method, a pulse oscillation type or a continuous-emission type excimer laser, YAG laser, or $YVO_4$ laser is used. When such laser is used, it is appropriate that laser light radiated from a laser oscillator is condensed by an optical system into a linear beam and is irradiated to the semiconductor film. Although the condition of annealing should be properly selected by an operator, a pulse oscillation frequency is made 30 Hz, and a laser energy density is made 100 to 400 mJ/cm$^2$ (typically 200 to 300 mJ/cm$^2$) when the excimer laser is used. It is appropriate that the second harmonic is used, a pulse oscillation frequency is made 1 to 10 kHz, and a laser energy density is made 300 to 600 mJ/cm$^2$ (typically, 350 to 500 mJ/cm$^2$) when the YAG laser is used. Then, laser light condensed into a linear shape with a width of 100 to 1000 μm, for example, 400 μm is irradiated to the whole surface of the substrate, and an overlapping ratio (overlap ratio) of the linear laser light at this time is made 80 to 98%.

Next, the gate insulating film 407 for covering the island shape semiconductor layer 403 to 406 is formed. The gate insulating film 407 with a thickness of 40 to 150 nm is formed by a plasma CVD method or a sputtering method with an insulating film including silicon. In this embodiment, the gate insulating film is formed of a silicon oxynitride film with a thickness of 120 nm. Of course, the gate insulating film 407 is not limited to such a silicon oxynitride film, and may be insulating film including silicon another as a single layer or a lamination structure.

The first conductive film 408*a* and the second conductive film 408*b* are formed on the gate insulating film 407 for forming a gate electrode. In this embodiment, the first conductive film 408*a* with a thickness of 50 to 100 nm is formed of tantalum nitride or titanium, and the second conductive film 408*b* with a thickness 100 to 300 nm is formed of tungsten. These materials are stable even under thermal processing at 400 to 600° C. in a nitrogen atmosphere, and the resistivity does not increase significantly.

Figure 4B:
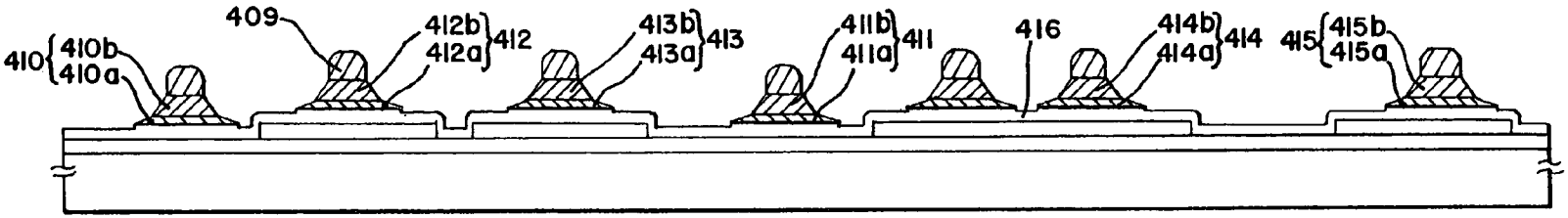

Next, as shown in FIG. 4B, mask 409 is formed of resist, and a first etching treatment for forming gate electrodes is carried out. Although there is no limitation on the etching method, an ICP (Inductively Coupled Plasma) etching method is preferably used, in which $CF_4$ and $Cl_2$ are mixed for an etching gas, and an RF (13.56 MHZ) power of 500 W is applied to a coil type electrode under a pressure of 0.5 to 2 Pa, preferably 1 Pa to generate plasma. An RF (13.56 MHZ) power of 100 W is also applied to the side of the substrate (sample stage), and substantially a negative self bias voltage is applied. When $CF_4$ and $Cl_2$ are mixed with each other, the tungsten film, the tantalum nitride film and the titanium film are etched to the same degree.

With the above etching conditions, the edges become taper-shaped due to the effect of the shapes of the masks of resist and the bias voltage applied to the substrate side. The angle of the taper portion becomes 25 to 45 degrees. In order to carry out the etching without leaving a residue on the gate insulating film, it is appropriate that an etching time is increased at a rate of about 10 to 20%. Since the selection ratio of the silicon oxynitride film to the tungsten film is 2 to 4 (typically 3), a surface, on which the silicon oxynitride film is exposed, is etched by about 20 to 50 nm by an over etching treatment. In this way, first shape conductive layers 410 to 415 made of first conductive layers and second conductive layers (first conductive layers 410*a* to 415*a* and second conductive layers 410*b* to 415*b*) are formed by the first etching treatment. Reference numeral 416 designates a gate insulating film, and regions which are not covered with the first shape conductive layers are etched by about 20 to 50 nm to be thin.

Figure 4C:
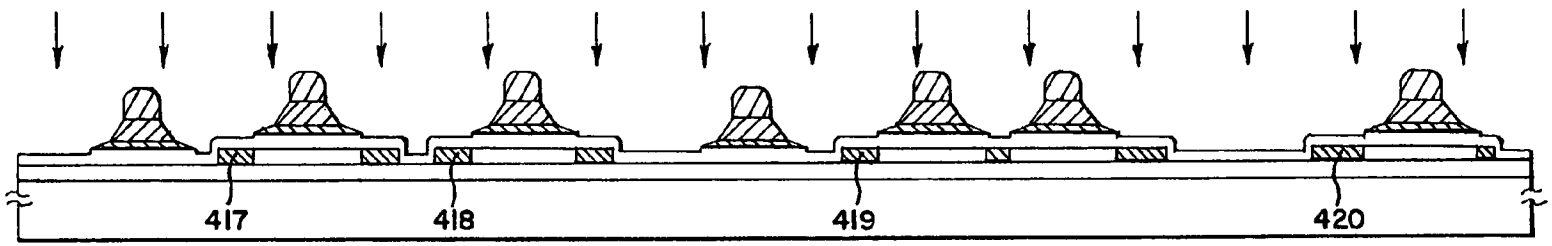

Then, as shown in FIG. 4C, a first doping treatment is carried out to dope an impurity element (donor) to give an n type conductivity. Doping may be carried out by an ion doping method or an ion injecting method. The condition of the ion doping method is that a dosage is $1\times10^{13}$ to $5\times10^{14}$ atoms/$cm^2$. As the impurity element to give the n type conductivity, an element which belongs to group 15, typically phosphorus (P) or arsenic (As) is used. In this case, the accelerating voltage is controlled (for example, 20 to 60 keV) and the first shape conductive layers are used as masks. The first impurity regions 417 to 420 are thus formed. The concentration of the impurity to give the n type conductivity is in the range of $1\times10^{20}$ to $1\times10^{21}$ atoms/$cm^3$ in the first impurity regions 417 to 420.

Figures 5A, 5B, 5C:
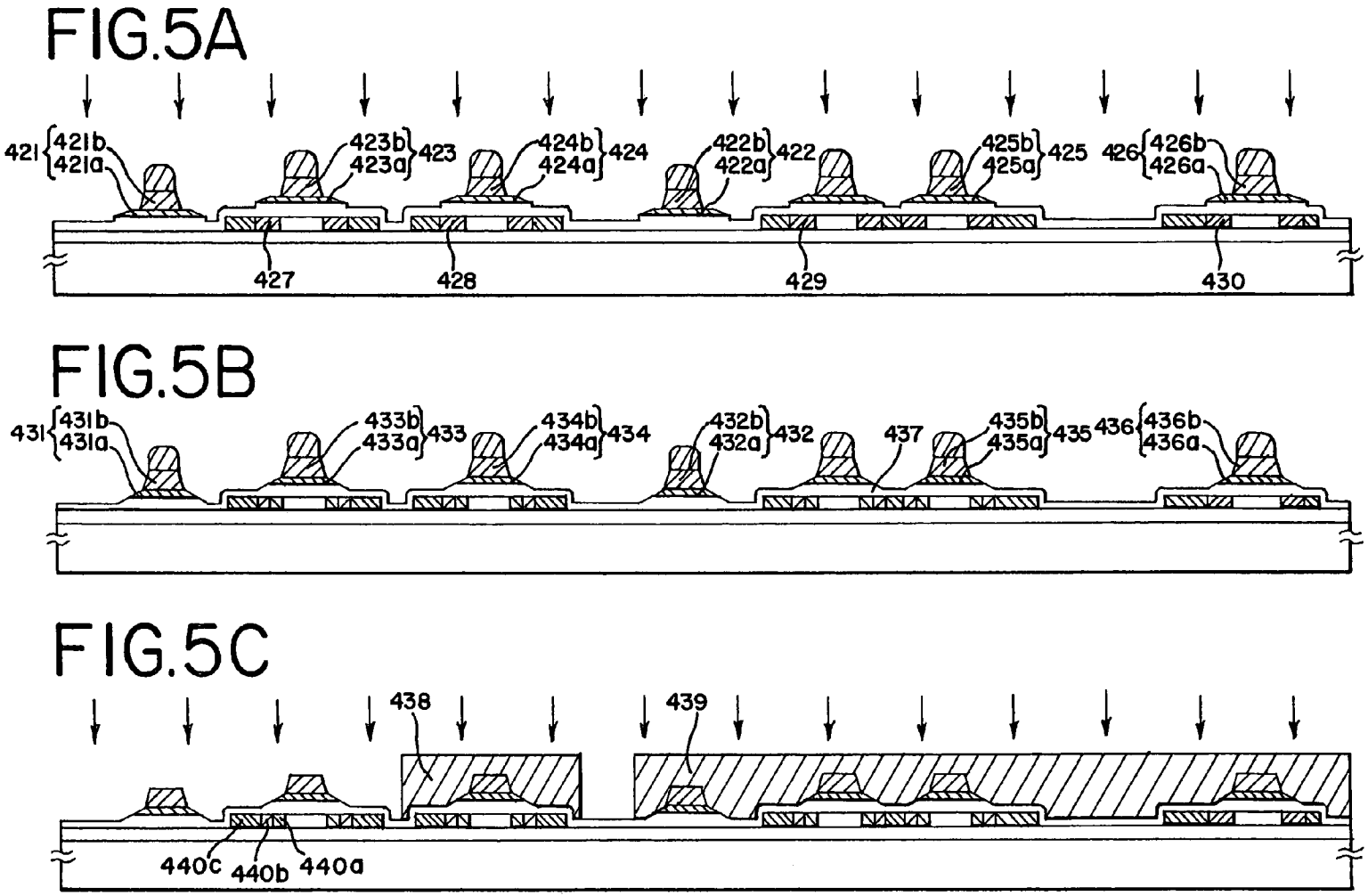
FIGS. 5A to 5C are cross sectional views explaining a manufacturing process for TFTs in the pixel portion and the peripheral circuit.

Next, as shown in FIG. 5A, a second etching treatment is carried out. The ICP etching device is similarly used, $CF_4$, $Cl_2$ and $O_2$ are mixed for an etching gas, and an RF power (13.56 MHZ) of 500 W is applied to a coil type electrode under a pressure of 1 Pa to generate plasma. An RF (13.56 MHZ) power of 50 W is applied to the side of the substrate (sample stage), and a lower self bias voltage as compared with the first etching treatment is applied. The tungsten film is anisotropically etched under the above condition, and the tantalum nitride film or the titanium film of the first conductive layers is left to reside. In this way, the second shape conductive layers 421 to 426 (first conductive layers 421*a* to 426*a* and second conductive layers 421*b* to 426*b*) are formed. Regions of the gate insulating film which are not covered with the second shape conductive layers 421 to 426 are further etched by about 20 to 50 nm to be thin.

Then, a second doping treatment is carried out. In this case, a dosage is made lower than that of the first doping treatment and an impurity (donor) to give the n type conductivity is doped under the condition of a high acceleration voltage. For example, an acceleration voltage is made 70 to 120 keV, and the treatment is carried out with a dosage of $1\times10^{13}$ atoms/$cm^2$, so that second impurity regions 427 to 430 are formed inside of the first impurity regions formed in the island-like semiconductor layers in FIG. 4C. Doping is carried out in such a manner that the second shape conductive layers 423*b* to 426*b* are used as masks to the impurity element and the impurity element is added to the regions under the second shape conductive layers 423*a* to 426*a*. In these impurity regions. Since, the second shape conductive layers 423*a* to 426*a* are left with substantially the same film thicknesses, the difference in the concentration distribution in the direction along the second shape conductive layers 423*a* to 426*a* is small and the n type impurity (donor) are included with a concentration of $1\times10^{17}$ to $1\times10^{19}$ atoms/$cm^3$.

Next, as shown in FIG. 5B, a third etching treatment is carried out, and an etching treatment of the gate insulating film is carried out. As a result, the second shape conductive layers 421*a* to 426*a* are also etched to become smaller with the edges withdrawn, and the third shape conductive layers 431 to 436 (the first conductive layers 431*a* to 436*a* and the second conductive layers 431*b* to 436*b*) are formed. Reference numeral 437 is a gate insulating film that is left behind, and the surface of the semiconductor film may be exposed by further carrying out etching.

For forming a p-channel TFT, resist masks 438 to 439 are formed, as shown in FIG. 5C, and p-type impurity (acceptor) is doped to the island-like semiconductor layer forming the p-channel TFT. In FIGS. 5B and 5C, the p-type impurity (acceptor) is selected from elements which belong to group 13, and typically boron (B) is used. The concentration of the impurity of the third impurity regions 440*a* to 440*c* is in the range of $2\times10^{20}$ to $2\times10^{21}$ atoms/$cm^3$. Since the third impurity regions include phosphorous, boron is added at the higher concentration than that of phosphorous to inverse the conductivity type.

In the steps shown in above embodiment, the impurity region is formed in the semiconductor layer. The third shape conductive layers 433 to 435 become a gate electrode in FIG. 5 and the third shape conductive layer 436 become a capacitor wiring. The third shape conductive layers 431 and 432 form wirings such as a source wiring.

Figure 6A:
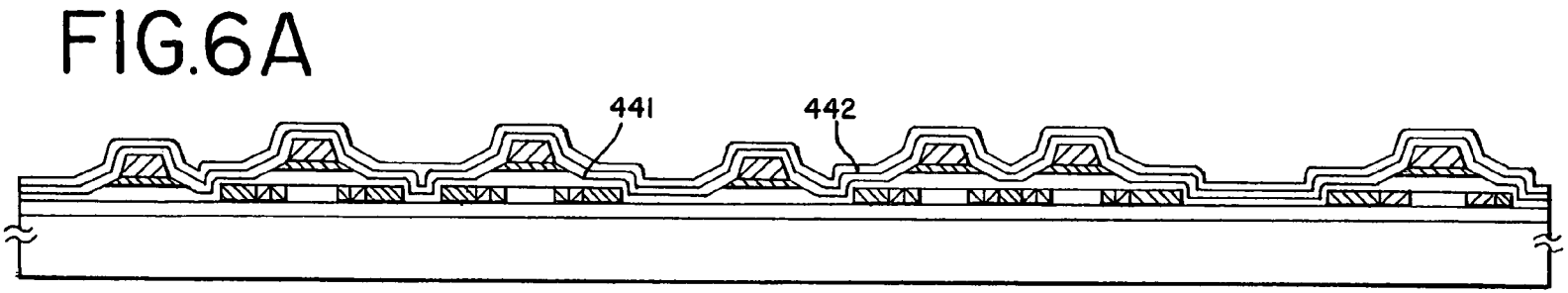
FIGS. 6A and 6B are cross sectional views explaining a manufacturing process for TFTs in the pixel portion and the peripheral circuit.

Next, as shown in FIG. 6A, a first insulating film 441 made from a silicon nitride film (SiN:H) or a silicon oxynitride film ($SiN_xO_y$:H) is formed by a plasma CVD method. Then, in order to control a conductivity type, a process for activating the impurity elements added to the respective island-shaped semiconductor layers is performed. It is preferable that the activation is made by a thermal anneal method using a furnace anneal oven. In addition, a laser anneal method or a rapid thermal anneal method (RTA method) can be applied. In the case of thermal anneal method, the anneal is made in a nitrogen atmosphere with an oxygen concentration of 1 ppm or less, preferably, 0.1 ppm or less, at 400 to 700° C. typically, 500 to 600° C. In this embodiment, a thermal treatment is performed at 500° C. for 4 hours.

After that, a second insulating film 442 made from a silicon nitride film (SiN:H) or a silicon oxynitride film ($SiN_xO_y$:H) is formed on the first insulating film 441. Then, a thermal treatment is performed at 350 to 500° C. By hydrogen released from the second insulating film 442, the semiconductor film is hydrogenated.

Figure 6B:
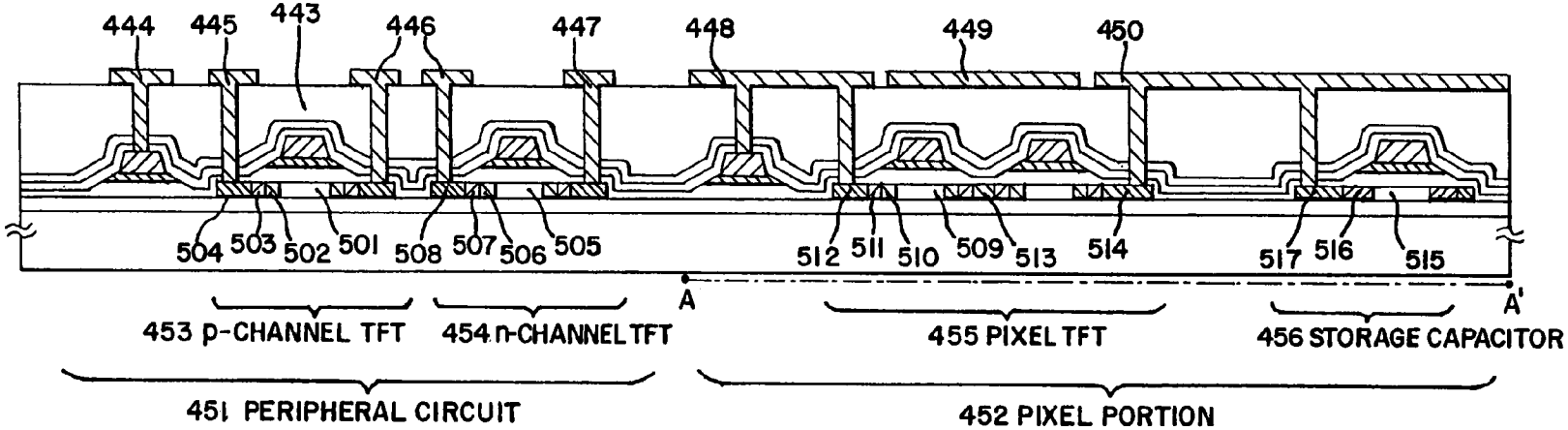

Further, as shown in FIG. 6B, a third insulating film 443 made of organic resin is formed at a thickness of about 1000 nm. As an organic resin film, polyimide, acrylic, polyimide-amide or the like, can be used. The advantages for using the organic resin film are as follows. That is, a film formation method is easy. Since the relative dielectric constant is low, a parasitic capacitance can be reduced. High flatness is obtained. Note that, an organic resin film except for the above material can be used. Here, the organic resin film is formed by firing at 300° C. using polyimide to be thermal-polymerized after the application to the substrate.

Next, as shown in FIGS. 6A and 6B, contact holes are formed through the third insulating film 443, the second insulating film 442, and the first insulating film 441. Then, a connection electrode 451 and source and drain wirings 444 to 447 are formed using aluminum (Al), titanium (Ti), tantalum (Ta) or the like. Also, a pixel electrode 450, a gate wiring 449, and a connection electrode 448 are formed in the pixel portion.

Thus, a peripheral circuit 451 formed by a p-channel TFT 453 and an n-channel TFT 454 and a pixel portion 452 having a pixel TFT 455 and a storage capacitor 456 are formed on the same substrate. In FIG. 6B, only cross sectional views of the p-channel TFT 453 and the n-channel TFT 454 in the peripheral circuit 451 are shown. However, the gate signal line driver circuit, the source signal line driver circuit, the image signal processing circuit, and the control circuit, as described in Embodiment 1, can be formed using these TFTs. These circuit structures may be suitably determined by a user.

The p-channel TFT 453 in the driver circuit (peripheral circuit) 451 has a channel forming region 501 and third impurity regions 502 to 504 which function as the source region or the drain region.

The n-channel TFT 454 has a channel forming region 505, second impurity regions 506 (gate overlapped drain: GOLD regions) overlapped with the gate electrode made from the third shape conductive layer 434, second impurity regions 507 (lightly doped drain: LDD regions) formed outside the gate electrode, and first impurity regions 508 which function as the source region or the drain region. The gate signal line driver circuit and the source signal line driver circuit, as descried in Embodiment 1, can be formed using these TFTs.

The pixel TFT 455 has a channel forming region 509, second impurity regions 510 (GOLD region) overlapped with the third shape conductive layer 435 forming the gate electrode, second impurity regions 511 (LDD region) formed outside the gate electrode, and first impurity regions 512, 513, and 514 which function as the source region or the drain region. Also, in the semiconductor film which functions as one electrode of the storage capacitor 456, impurity regions 516 and 517 and a region 515 to which an impurity is not added are formed.

In the pixel portion 452, the electrical connection is made between the source wiring 432 and the source or drain region 512 of the pixel TFT 455 through the connection electrode 448. In addition, the electrical connection is made between the gate wiring 449 and the gate electrode 435. Further, the pixel electrode 450 is connected with the source or drain region 514 of the pixel TFT 455 and the impurity region 517 of the semiconductor film as one electrode of the storage capacitor 456.

Figure 7:
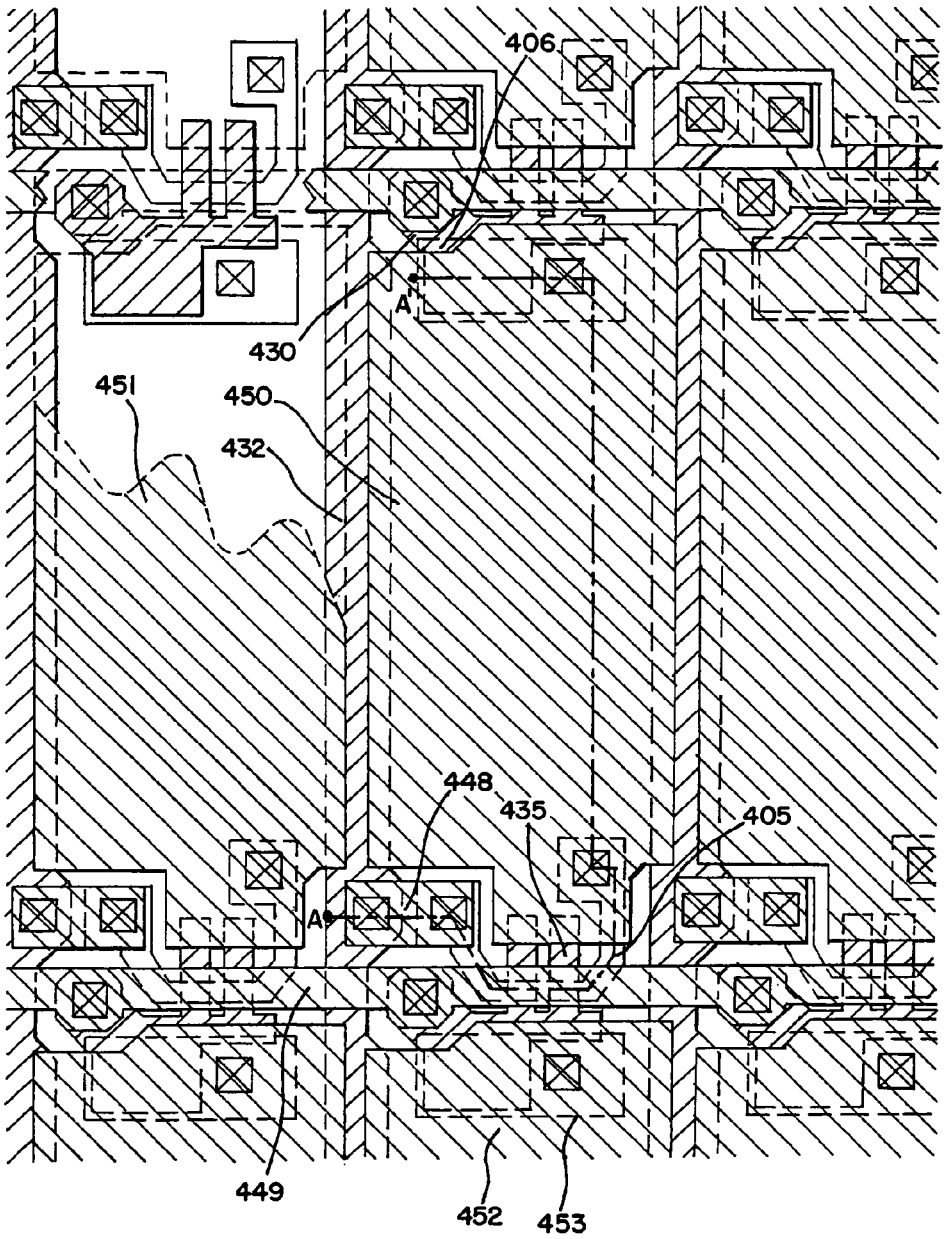
FIG. 7 is an upper view explaining a pixel structure of the pixel portion.
Figure 8:
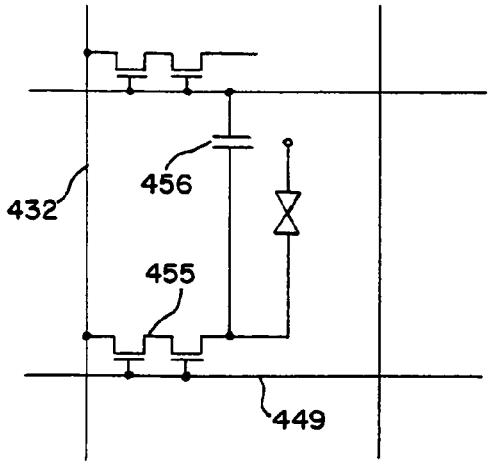
FIG. 8 is a circuit diagram of a pixel in a liquid crystal display device.

The cross sectional view of the pixel portion 452 in FIG. 6B corresponds to a line A-A shown in FIG. 7. The gate electrode 435 is combined with one electrode of the storage capacitor in the adjacent pixel. A capacitor is formed in a portion that the gate electrode 435 is overlapped with the semiconductor layer 453 connected with the pixel electrode 452. Also, with respect to a positional relationship among the source wiring 432, the pixel electrode 450, and an adjacent pixel electrode 451, end portions of the pixel electrodes 450 and 451 are provided over the source wiring 432 to form an overlapped region. Thus, a light shielding effect is improved by shielding stray light. FIG. 8 shows an equivalent circuit of such a pixel.

As described above, the driver circuits and the pixel portion of the active matrix display device of FIG. 3 as described in Embodiment 1, can be formed.

Embodiment 3

Figure 16:
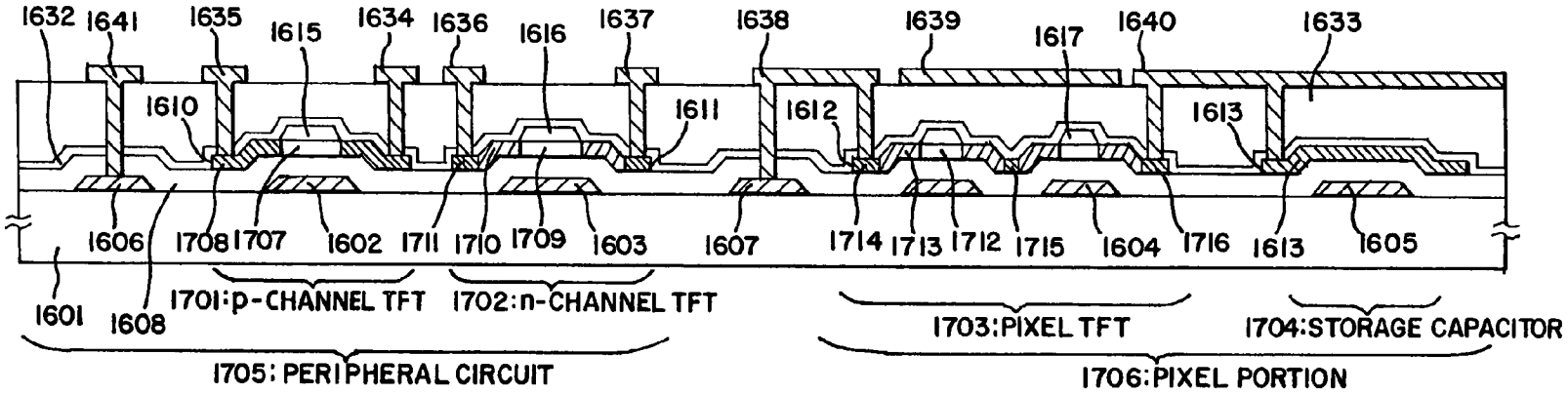
FIG. 16 is a cross sectional view explaining TFTs in the pixel portion and the peripheral circuit.

FIG. 16 shows one example of an active matrix display device manufactured using inverse stagger type TFTs. As Embodiment 2, a peripheral circuit 1705 formed by a p-channel TFT 1701 and an n-channel TFT 1702 and a pixel portion 1706 having a pixel TFT 1703 and a storage capacitor 1704 are formed on a substrate 1601. In FIG. 16, only cross sectional views of the p-channel TFT 1701 and the n-channel TFT 1702 in the peripheral circuit 1705 are shown. However, the gate signal line driver circuit, the source signal line driver circuit, the image signal processing circuit, and the control circuit, as described in Embodiment 1, can be formed using these TFTs.

Gate electrodes 1602 to 1604, source and drain lines 1606 and 1607, and a capacitor wiring 1605 are formed on the substrate 1601 by using a material selected from molybdenum (Mo), tungsten (W), tantalum (Ta), aluminum (Al), and the like. Then, a first insulating film 1608 which is an insulating film containing silicon and used as an gate insulating film is formed thereon. Semiconductor films 1610 to 1613 are formed using a crystalline semiconductor material containing silicon and regions containing a p-type impurity or an n-type impurity are formed therein. Channel protective films 1615 to 1617 may be formed on channel forming regions of TFTs. A second insulating film 1632 made from a silicon nitride film or a silicon oxynitride film and a third insulating film 1633 made of an organic resin material are formed as upper layers of channel protective film 1615 to 1617. In addition, source and drain wirings 1634 to 1637, a pixel electrode 1640, a gate wiring 1639, and a connection electrode 1638 are formed using aluminum (Al), titanium (Ti), tantalum (Ta) or the like.

In the p-channel TFT 1701 of the peripheral circuit 1705, a channel forming region 1707 and source and drain regions 1708 made from p-type impurity regions are formed. In the n-channel TFT 1702, a channel forming region 1709, LDD regions 1710 made from n-type impurity regions, the source or drain regions 1711 made from n-type impurity regions are formed. The pixel TFT 1703 in the pixel portion 1706 has a multigate structure, a channel forming region 1712, LDD regions 1713, and the source and drain regions 1714 to 1716 are formed therein. The n-type impurity region located between the LDD regions is useful to reduce an off current. The storage capacitor 1704 is composed of the capacitor wiring 1605, the semiconductor layer 1613, and the first insulating film formed therebetween.

In the pixel portion 1706, the electrical connection is made between the source wiring 1607 and the source or drain region 1714 of the pixel TFT 1703 through the connection electrode 1638. Also, the electrical connection is made between the gate wiring 1639 and a first electrode. Further, the pixel electrode 1640 is connected with the source or drain region 1716 of the pixel TFT 1703 and the semiconductor film 1613 of the storage capacitor 1704.

Even if such inverse stagger type TFTs are used, although the layers in which the gate electrode and the semiconductor film are formed are changed, the pixels with the same structure as in FIG. 7 can be formed. Thus, the driver circuits and the pixel portion of the active matrix display device of FIG. 3, as described in Embodiment 1, can be formed.

Embodiment 4

One example in the case where an EL display device is manufactured using the active matrix display device with the structure shown in FIG. 3 will be described. A control circuit for detecting a light intensity of a surrounding and then correcting an image signal, an image signal processing circuit, a gate signal line driver circuit, and a source signal line driver circuit have the same structure as in FIG. 3. Thus, in this embodiment, a schematic cross sectional structure of the pixel portion will be described using FIG. 9A.

Figure 9A:
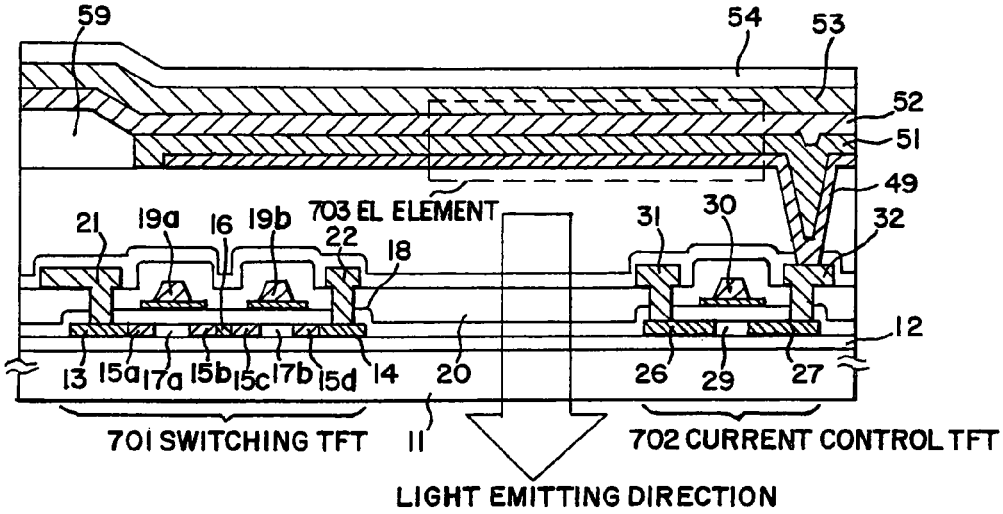
FIGS. 9A and 9B are a cross sectional view and an equivalent circuit diagram of a pixel in an EL display device.

In FIG. 9A, reference numeral 11 denotes a substrate and 12 denotes a blocking layer. As the substrate 11, a light transmitting substrate, typically, a glass substrate, a quartz substrate, a glass ceramic substrate, or a crystallized glass substrate can be used. Note that it is required that the substrate resists a maximum processing temperature in a manufacturing process.

Reference numeral 701 denotes a switching TFT formed using n-channel TFTs. The switching TFT may be formed using p-channel TFTs. In addition, reference numeral 702 denotes a current control TFT. FIG. 9A shows the case where the current control TFT 702 is formed using a p-channel TFT. In this case, the drain of the current control TFT is connected with the anode of an EL element. Note that, it is not required that the switching TFT is limited to the n-channel TFT and the current control TFT is limited to the p-channel TFT. The display device may be structured such that the switching TFT is formed using p-channel TFTs and the current control TFT is formed using the n-channel TFT. Also, the display device may be structured such that both the switching TFT and the current control TFT are formed using the p-channel TFTs or the n-channel TFTs.

The switching TFT 701 has an active layer, a gate insulating film 18, gate electrodes 19*a* and 19*b*, a first interlayer insulating film 20, a source wiring 21, and a drain wiring 22. The active layer includes a source region 13, a drain region 14, LDD regions 15*a* to 15*d*, a high concentration impurity region 16, and channel forming regions 17*a* and 17*b*. Note that the gate insulating film 18 or the first interlayer insulating film 20 may be commonly used for all TFTs on the substrate. Alternatively, different films may be used for respective circuits or respective elements.

Also, in the switching TFT 701 as shown in FIG. 9A, the gate electrodes 19*a* and 19*b* are electrically connected with each other, and thus a so-called double gate structure is obtained. Of course, except for the double gate structure, a so-called multigate structure (structure including an active layer having a plurality of channel forming regions which are connected with each other in series) such as a triple gate structure may be obtained.

The multigate structure is extremely useful to reduce an off current. If the off current in the switching TFT 701 is made sufficiently low, a capacitance required for a capacitor can be decreased in accordance with an amount of the off current. That is, an occupying area of the capacitor can be decreased. Thus, the multigate structure is useful to expand the effective light emitting area of an EL element 703.

Further, in the switching TFT 701, the LDD regions 15*a* to 15*d* are provided so as not to be overlapped with the gate electrodes 19*a* and 19*b* through the gate insulating film 18. Such a structure is very useful to reduce the off current. Also, the length (width) of the respective LDD regions 15*a* to 15*d* may be 0.5 to 3.5 μm, typically, 2.0 to 2.5 μm.

Note that, it is further preferable that an offset region is provided between the channel forming region and the LDD region to reduce the off current. The offset region is made from a semiconductor layer containing the same composition as the channel forming region and a region to which the gate voltage is not applied. In addition, in the case of the multigate structure having a plurality of gate electrodes, the separation region (high concentration impurity region) 16 provided between the channel forming regions is effective to reduce the off current. The separation region 16 is a region to which the same impurity element with the same concentration as the source region or the drain region is applied.

Next, the current control TFT 702 has a source region 26, a drain region 27, a channel forming region 29, a gate insulating film 18, a gate electrode 30, a first interlayer insulating film 20, a source wiring 31, and a drain wiring 32 to be formed. Note that, although the gate electrode 30 is formed with a single gate structure, it may be formed with a multigate structure.

Figure 9B:
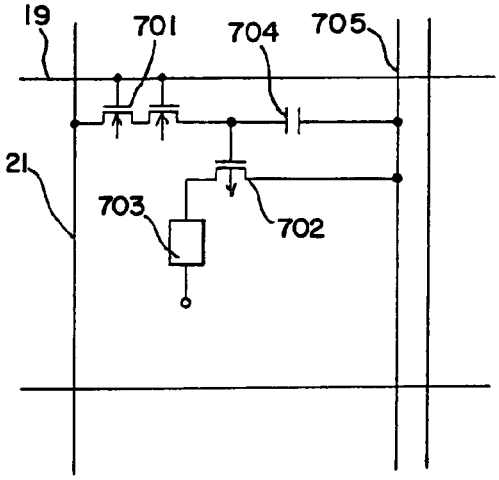

FIG. 9B shows an equivalent circuit of a pixel of this EL display device. The drain of the switching TFT 701 is connected with the gate of the current control TFT 702. Also, numeral shows a gate wiring constituting the gate electrodes 19*a* and 19*b*, and numeral 704 shows a storage capacitor. Concretely, the gate electrode 30 of the current control TFT 702 of FIG. 9A is electrically connected with the drain region 14 of the switching TFT 701 through the drain wiring (can also be called connection wiring) 22. In addition, the source wiring 31 is connected with a power source supply line 705 of FIG. 9B.

In view of increasing an amount of a current flowing into the EL layer, it is effective to make the active layer (in particular, the channel forming region) of the current control TFT 702 thick in film thickness (preferably, 50 to 100 nm, further preferably, 60 to 80 nm). On the other hand, in view of reducing the off current in the case of the switching TFT 701, it is effective to make the active layer (in particular, the channel forming region) thereof thin in film thickness (preferably, 20 to 50 nm, further preferably, 25 to 40 nm).

Reference numeral 47 denotes a first passivation film, and its film thickness may be 20 nm to 200 nm. As its material, an insulating film containing silicon (in particular, a silicon oxynitride film or a silicon nitride film is preferable) can be used. This first passivation film 47 has a function for protecting the formed TFTs from alkali metal and moisture. Finally, the EL layer provided over the TFTs contains alkali metal such as sodium. That is, the first passivation film 47 functions as a protective layer for preventing the penetration of the alkali metal (mobile ion) into the TFTs.

Also, reference numeral 48 denotes a second interlayer insulating film, and it has a function as a leveling film for leveling a step produced by the TFT. As the second interlayer insulating film 48, an organic resin film is preferable, polyimide, polyamide, acrylic, BCB (benzocyclobutane) or the like and may be used. The organic resin film has advantages that a preferable leveling surface is easily formed and a relative dielectric constant is low. Since the EL layer is very sensitive to unevenness, it is desirable that the step by the TFT mostly removed by the second interlayer insulating film. In addition, in order to decrease a parasitic capacitance produced between the gate wiring or the data wiring and the cathode of the EL element, it is desirable that a material having a low relative dielectric constant is provided thick. Thus, it is preferable that the film thickness is 0.5 to 5 μm (preferably, 1.5 to 2.5 μm).

Reference numeral 49 denotes a pixel electrode (anode of the EL element) made from a transparent conductive film. After a contact hole (opening hole) is formed in the second interlayer insulating film 48 and the first passivation film 47, the pixel electrode 49 is formed so as to connect with the drain wiring 32 of the current control TFT 702 through the formed opening hole. Note that, as shown in FIG. 9A, when the pixel electrode 49 and the drain region 27 are not directly connected with each other, it can be prevented that the alkali metal in the cathode penetrates the active layer through the pixel electrode.

Bumps 59 are formed with an insulating material on the second interlayer insulating film 48, and an EL layer 51 is formed therebetween. The EL layer 51 is used with a single layer or a lamination structure. In the case of the lamination structure, high light emitting efficiency is obtained. Generally, a hole injection layer, a hole transport layer, a light emitting layer, and an electron transport layer are formed on the pixel electrode in this order. However, a lamination structure of the hole transport layer, the light emitting layer, and the electron transport layer, or a lamination structure of the hole injection layer, the hole transport layer, the light emitting layer, the electron transport layer, and an electron injection layer may be used. In the present invention, any known structures may be used. In addition, the EL layer is doped with fluorescent dye or the like.

As an organic EL material, for example, a material disclosed in the U.S. Pat. Nos. 4,356,429, 4,539,507, 4,720,432, 4,769,292, 4,885,211, 4,950,950, 5,059,861, 5,047,687, 5,073,446, 5,059,862, 5,061,617, 5,151,629, 5,294,869, or 5,294,870, or Japanese Patent Application Laid-open No. Hei 10-189525, 8-241048, or 8-78159 can be used.

Note that, there are roughly four types of color display systems in the EL display device. That is, there are a system in that three kinds of EL elements are formed corresponding to R (red), G (green) and B (blue), a system in which an EL element for emitting white color light is combined with color filters, a system in which an EL element for emitting blue color light or blue-green light is combined with a phosphor (fluorescence color conversion layer: CCM), and a system in which EL elements are correspondingly overlapped with R, G, and B using a transparent electrode as a cathode (counter electrode). Note that, there are light emitting (fluorescence) due to singlet excitation and light emitting (phosphorescence) due to triplet excitation in EL. The EL in this specification includes the light emitting (fluorescence), the light emitting (phosphorescence), or light emitting in that both light emitting are mixed with each other.

The structure of FIG. 9A shows the example in the case where the system for forming three kinds of EL elements corresponding to R, G, and B is used. Note that one pixel is shown in FIG. 9A. However, respective pixels with the same structure are formed corresponding to red color, green color, and blue color, and thus color display can be made.

A cathode 52 of the EL element is provided on the EL layer 51. As the cathode 52, a material containing magnesium (Mg), lithium (Li), or calcium (Ca), having a small work function, is used. Preferably, an electrode made of MgAg (material obtained by mixing Mg with Ag at Mg:Ag=10:1) may be used. In addition, an MgAgAl electrode, an LiAl electrode or an LiFAl electrode may be used.

It is desirable that, after the formation of the EL layer 51, the cathode 52 is subsequently formed without exposing it to an air. This is because the light emitting efficiency of the EL element is greatly influenced by an interface state between the cathode 52 and the EL layer 51. Note that a light emitting element composed of the pixel electrode (anode), the EL layer, and the cathode is called an EL element in this specification.

It is necessary to individually form the lamination made of the EL layer 51 and the cathode 52 for respective pixels. However, since the EL layer 51 is extremely weak to moisture, a general lithography technique cannot be used. Thus, it is preferable that the EL layer 51 is selectively formed by a vapor-phase deposition method such as a vacuum evaporation method, a sputtering method, or a plasma CVD method, using a physical mask member such as a metal mask.

Note that, after the EL layer 51 is selectively formed by using an inkjet method, a screen printing method, a spin coating method or the like, the cathode can be formed by using a vapor deposition method such as an evaporation method, a sputtering method, or a plasma CVD method.

Reference numeral 53 denotes a protective electrode. This protective electrode 53 is an electrode for protecting the cathode 52 from external moisture or the like and for connecting the cathodes 52 of the respective pixels to each other. It is preferable that a low resistance material including aluminum (Al), copper (Cu), or silver (Ag) is used as the protective electrode 53. A heat radiation effect for reducing heat generation of the EL layer 51 can be expected for this protective electrode 53. In addition, it is effective that after the formations of the EL layer 51 and the cathode 52, the protective electrode 53 is subsequently formed without exposing them to an air.

Reference numeral 54 denotes a second passivation film. Its film thickness may be 10 nm to 1 μm (preferably, 200 to 500 nm). The second passivation film 54 is provided mainly for protecting the EL layer 51 from moisture. It is effective that the film 54 has the heat radiation effect. Note that, as described above, the EL layer is weak to heat. Thus, it is desirable that the EL layer is formed at a lower temperature (preferably, in a temperature range of a room temperature to 120° C.). Therefore, a plasma CVD method, a sputtering method, a vacuum evaporation method, an ion plating method, or a solution applying method (spin coating method) will be a desirable film formation method. In the structure as shown in FIG. 9A, a light emitting direction viewed from the EL element is toward the side of the substrate 11. The EL display device with such a pixel structure displays an image through the substrate 11.

Figure 10A:
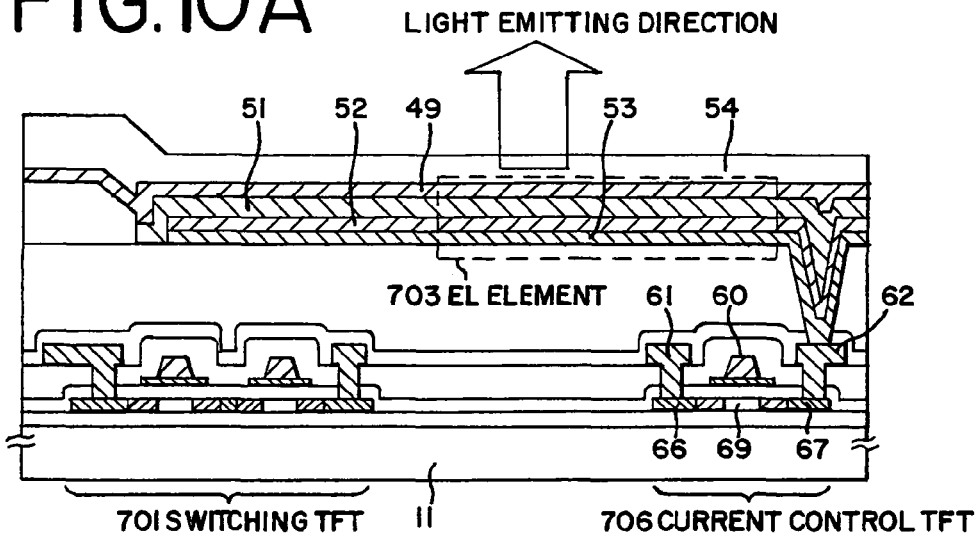
FIGS. 10A and 10B are a cross sectional view and an equivalent circuit diagram of the pixel in the EL display device.
Figure 10B:
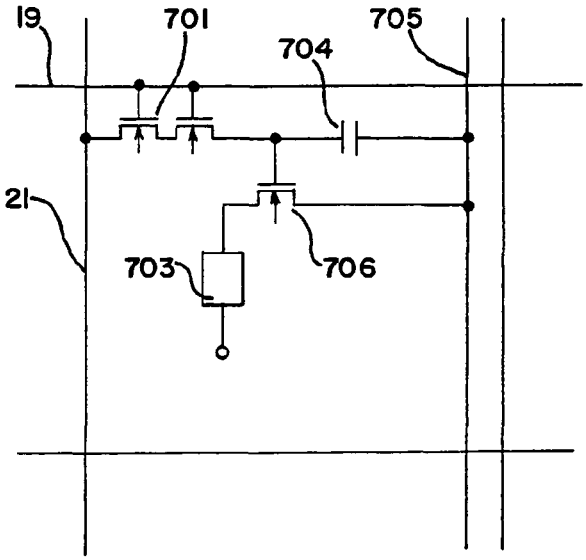

On the other hand, FIG. 10A is a cross sectional view of a pixel structure in the EL display device, as FIG. 9A. A light emitting direction viewed from the EL element is toward the side opposite to that of the substrate 11. The EL display device with such a pixel structure displays an image on a surface that the EL element 703 is formed. In this case, although the switching TFT 701 is the same as in FIG. 9A, an n-channel TFT is used as a current control TFT 706. The current control TFT 706 has a source region 66, a drain region 67, a channel forming region 69, the gate insulating film 18, a gate electrode 60, the first interlayer insulating film 20, a source wiring 61, and a drain wiring 62 to be formed. Note that, although the gate electrode 60 is formed with a single gate structure, it may be formed with a multigate structure. An equivalent circuit of such a pixel is shown in FIG. 10B.

Also, reference numeral 53 denotes a pixel electrode (cathode side of the EL element) formed using Al, Cu, Ag or the like, and the cathode 52 of the EL element is provided thereon. It should be noted that the light emitting efficiency of the EL element is greatly influenced by an interface state between the cathode 52 and the EL layer 51. The EL layer 51 is formed with a single layer or a lamination structure, and the transparent electrode (anode side) (pixel electrode) 49 and further the second passivation film 54 are provided thereon.

The point of the present invention is as follows. That is, in the active matrix EL display device, a change in a surrounding is detected by a sensor. Then, based on this detection information, an amount of a current flowing into the EL element is controlled to control a light emitting brightness of the EL element. Thus, the present invention is not limited to the structure in the EL display device of FIG. 9A. The structure of FIG. 9A is one of preferred embodiments of the active matrix display device with the structure shown in FIG. 3, as described in Embodiment 1. Therefore, the pixel portion in the active matrix display device described in Embodiment 1 can be manufactured using the EL element.

Embodiment 5

Figure 12:
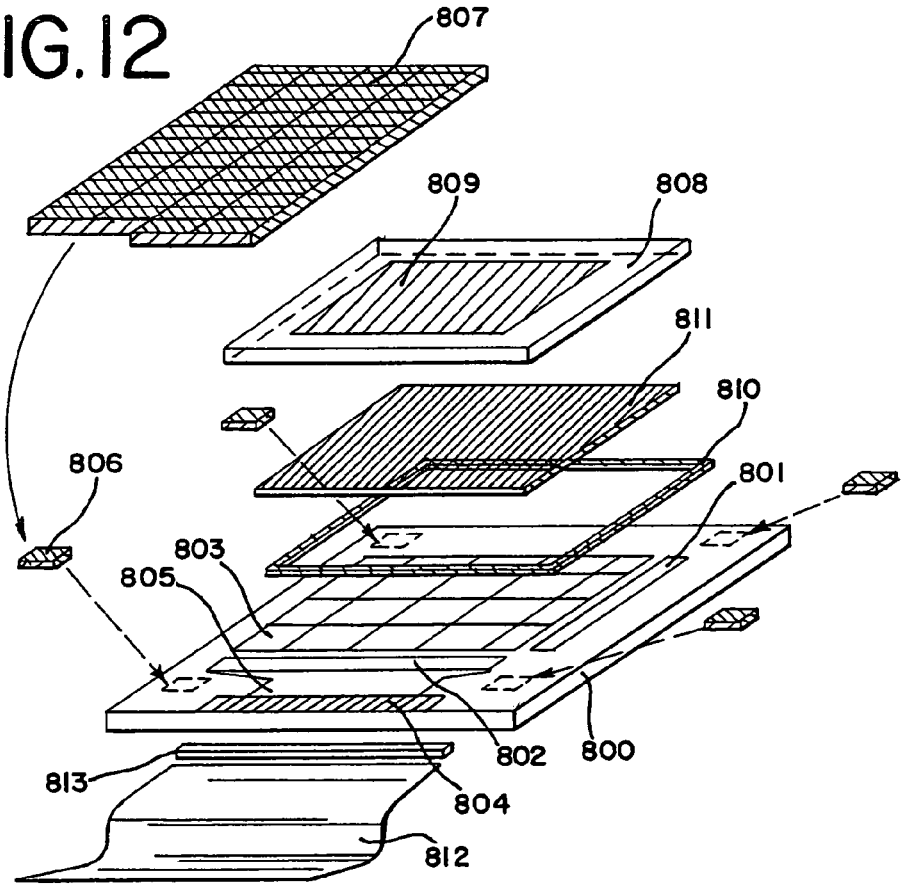
FIG. 12 is an assembly view of the display device in which the photosensor is mounted.

FIG. 12 is a conceptual view representing a state that the photosensors described in Embodiment 1 are included in the active matrix display device. Note that this embodiment represents a liquid crystal display device as one example. However, a concept representing a state that the photosensors manufactured in another substrate are included in the active matrix substrate, can be also applied to the EL display device.

In a first substrate 800 in which a pixel portion is formed, a driver circuit (A) 801, a driver circuit (B) 802, a pixel portion 803, an external input and output terminal 804, and connection wiring 805 are formed. The pixel portion 803 is formed such that the pixel TFTs are arranged in a matrix form, as described in Embodiment 2. The driver circuit (A) 801 and the driver circuit (B) 802 are formed similarly as the pixel portion 803. An opposing electrode 809 is formed in a second substrate 808. The second substrate 808 is adhered to the first substrate 800 through a sealing member 810. Liquid crystal is filled inside the sealing member 810 to form a liquid crystal layer 811. The first substrate and the second substrate are bonded together with a predetermined interval. In the case of nematic liquid crystal, the interval is set to be 3 to 8 μm. In the case of smetic liquid crystal, the interval is set to be 1 to 4 μm.

An FPC (flexible printed circuit) 812 for inputting a power source signal and a control signal from an external is bonded to the external input and output terminal 804. A reinforcing plate 813 may be provided so as to increase the bond strength of the FPC 812.

A thin film element in which a photoelectric conversion layer is formed using amorphous silicon, CdS, or the like, is used. A plurality of photosensors 806 obtained by dividing a photosensor body manufactured in a third substrate 807, are mounted on the first substrate 800. A mounting method is slightly changed in accordance with the relation between the light incident direction of the photosensor and the display direction of the pixel portion. Basically, the mounting is made by a facedown method using conductive resin.

Figure 11A:
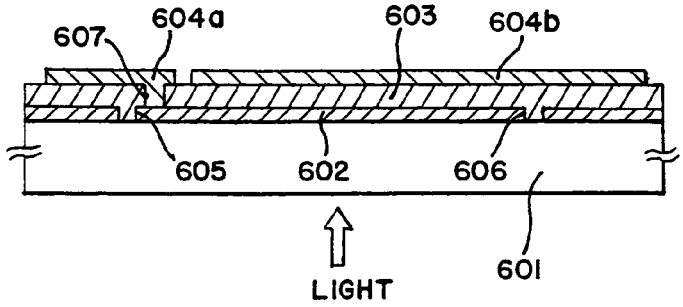
FIGS. 11A and 11B are cross sectional views of the photosensor.

FIG. 11 shows one example of the photosensor using amorphous silicon for the photoelectric conversion layer. FIG. 11A shows the photosensor in which a transparent electrode 602, a photoelectric conversion layer 603, and light reflective electrodes 604*a* and 604*b* are formed on a light transmitting substrate 601. The photoelectric conversion layer 603 is formed with a pin junction, and an I-type layer is formed using amorphous silicon. Although the direction of the junction is arbitrary, for example, the junction is formed such that a p-type layer is in contact with the transparent electrode 602 and an n-type layer is contact with the light reflective electrode 604*a* and 604*b*. The transparent electrode 602 is separated from end portions of the substrate 601 by holes 605 and 606 to prevent a short circuit. The light reflective electrodes are also used as an external connection terminal. The light reflective electrode 604*a* is electrically connected with the transparent electrode 602 through the hole 607 formed in the photoelectric conversion layer 603 and becomes a plus (+) terminal. The light reflective electrode 604*b* becomes a minus (−) terminal. In the case of FIG. 11A, a light receiving surface is made in the side of the light transmitting substrate 610, and thus light transmitted through the substrate 601 is incident into the photoelectric conversion layer 603.

Figure 11B:
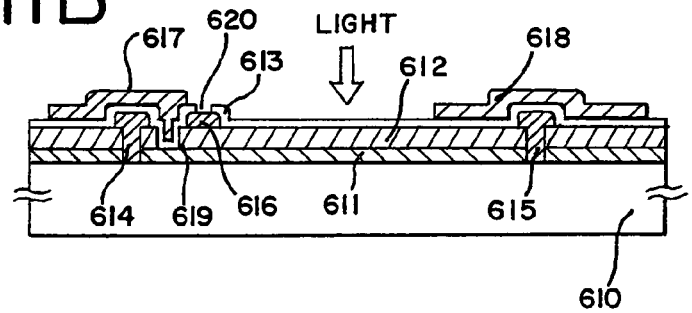

FIG. 11B shows the photosensor in which a light reflective electrode 611, a photoelectric conversion layer 612, and transparent electrodes 613 are formed on a substrate 610. The photoelectric conversion layer 612 is formed with a pin junction, and an I-type layer is formed using amorphous silicon. Although the direction of the junction is arbitrary, preferably, the structure is made such that a p-type layer is in contact with the transparent electrode 613 and an n-type layer is contact with the light reflective electrode 611. The light reflective electrode 611 and the photoelectric conversion layer 612 are separated from end portions of the substrate 610 by holes 614 and 615 to prevent a short circuit. External connection terminals 617 and 618 are made of conductive paste such as silver and selectively formed on the transparent electrode 613. The external connection terminal 617 is electrically connected with the light reflective electrode 611 through the hole 614 and becomes a minus (−) terminal (contact in the n-type layer side). The external connection terminal 618 becomes a plus (+) terminal (contact in the p-type layer side). In the case of FIG. 11B, a light receiving surface is made in the side that the transparent electrode 613 is formed.

Figure 13A:
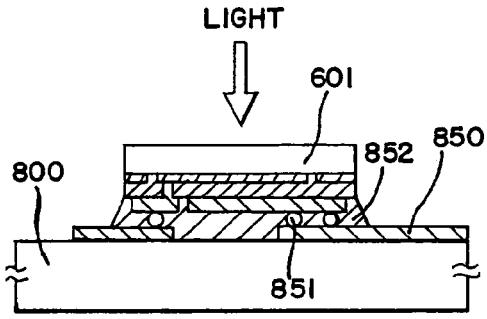
FIGS. 13A and 13B are cross sectional views explaining a connection method of the photosensor and a light incident direction.

Thus, the photosensor can be classified into two types in view of the direction that light is incident into the photoelectric conversion layer. The photosensor is mounted on the substrate in which the pixel portion, the driver circuit, and the control circuit are formed. In this case, the photosensor is mounted so as to be in contact with the wirings formed on the same surface of the substrate. FIG. 13A shows this detail.

FIG. 13A shows an example in the case where the photosensor of FIG. 11A is mounted on the substrate. In this case, light is incident into the photosensor from the side of the substrate 601 on which the photosensor is formed. The photosensor is aligned with wirings 850 formed on a substrate 800, and then adhered to the substrate 800 by light or heat stiffen resin 852. The electrical connection to the wirings 850 is made through conductive particles 851 contained in the resin 852.

Figure 13B:
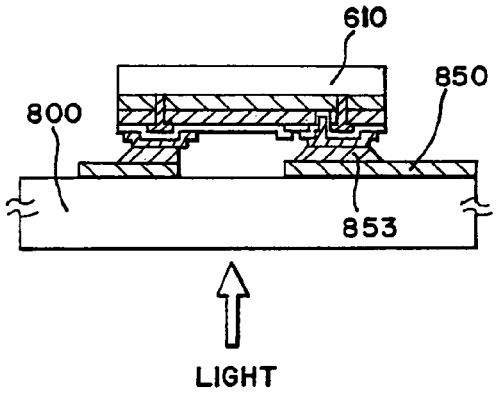

FIG. 13B shows an example in the case where the photosensor of FIG. 11B is mounted on the substrate. In this case, the photosensor is constructed such that light transmitted through the substrate 800 is incident into the photosensor. The photosensor is aligned with wirings 850 formed on the substrate 800, and then adhered to the wirings 850 by a conductive material 853 such as cream solder or silver paste.

As shown in FIG. 12, a plurality of photo sensors are formed in the third substrate 807 and then mounted on the first substrate 800 in which the pixel portion and the driver circuit are formed. Thus, a process for completing the display device can be simplified. A design rule for the photosensor used in the present invention is different from that for the substrate for forming the active matrix display device. The design rule of several μm to submicron is required for the latter. On the other hand, the former is manufactured with the design rule of several tens of micron to several hundreds of micron. In the photosensor, its pattern can be formed by a laser processing, a screen printing, or the like.

Embodiment 6

Figure 14A:
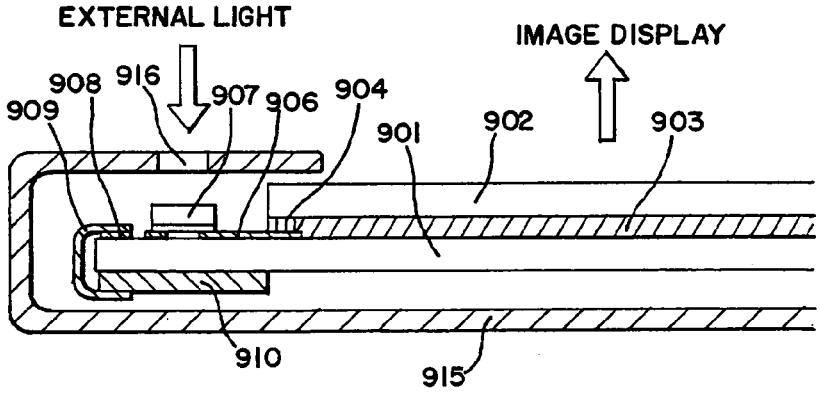
FIGS. 14A and 14B are cross sectional views representing a state that the display device of the present invention is incorporated into a device body.
Figure 14B:
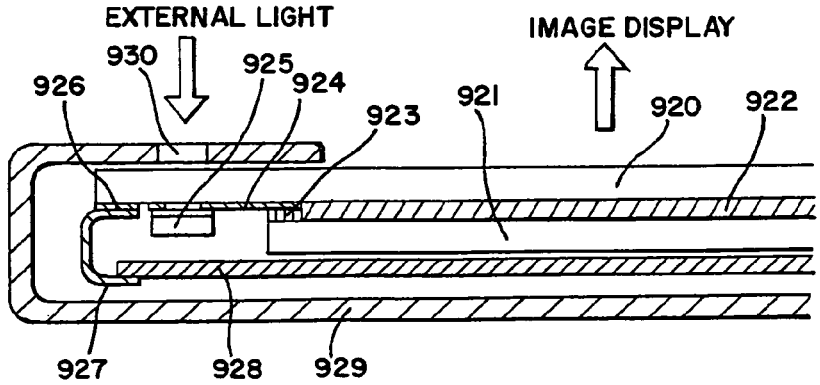

One example of a method of incorporating an active matrix display device on which the photosensor as described in Embodiment 1 is mounted, into various electronic devices, is shown in FIGS. 14A and 14B. FIG. 14A shows this example, and there are a substrate 901 in which elements such as TFTs are formed, a counter substrate 902, and an element forming region 903 formed therebetween. A detailed structure of the element forming region 903 is omitted. However, in the case of a liquid crystal display device, in addition to the pixel TFT as shown in FIG. 6B or 16, a liquid crystal layer and the like are formed on the pixel electrode. Also, in the case of an EL display device, as shown in FIG. 9A or 10A, the switching TFT, the current control TFT, the EL element, and the like are formed. In addition, as shown in FIG. 3, various circuits provided around the pixel portion may be included. The element forming region 903 is filled between two substrates by a sealing member 904 so as not to expose it to an air. Thus, the reliability of the display device is improved.

A photosensor 907 is fixed to the substrate 901 in which the pixel portion is formed and the electrical connection to a circuit in the element forming region 903 is made. In this case, the method as shown in FIG. 13A is used as the connection method. The photosensor 907 is mounted outside the counter substrate 902. One end of an input and output terminal 908 is connected with a flexible printed circuit (FPC) 909. The FPC 909 is connected with a printed substrate 910 in which a signal processing circuit, an amplifier circuit, a power source circuit, and the like are provided. Thus, signals required for an image display can be transmitted. In addition, although a polarization plate is omitted, it may be suitably provided if necessary.

The image display (display light) is made by light emitted to the side of the counter substrate 902, and thus this surface corresponds to a display surface. Light is incident into the photosensor through a hole 916 provided in a housing 915. In this case, the photosensor with the structure as shown in FIG. 11A is used. An output of the photosensor is connected with a control circuit through a wiring 906.

The structure of FIG. 14A can be applied to a reflection type liquid crystal display device. In addition, although not shown, when a backlight unit is provided under the substrate 901 in which the pixel portion is formed, this structure can be used for a transmission type liquid crystal display device. In addition, this structure can be applied to the EL display device with the structure as shown in FIG. 10A.

FIG. 14B shows another example, a substrate 920 in which elements such as TFTs are formed and a counter substrate 921 are fixed to each other by a sealing member 923, and an element forming region 922 formed therebetween. A photosensor 925 is fixed to the substrate 920 in which the elements such as the TFTs are formed, and is electrically connected with a circuit in the element forming region 922. The method as shown in FIG. 13B is used as the connection method. One end of an input and output terminal 926 is connected with a flexible printed circuit (FPC) 927. The FPC 927 is connected with a printed circuit 928 in which a signal processing circuit, an amplifier circuit, a power source circuit, and the like are provided. Thus, signals required for an image display can be transmitted. The image display (display light) is made by light emitted to the side of the substrate 920, and thus this surface corresponds to a display surface. External light is led from a hole 930 provided in a housing 929. The light transmitted through the substrate 920 in which the elements such as the TFTs are formed, is incident into the photosensor 925. An output of the photosensor is connected with a control circuit through a wiring 924.

The structure of FIG. 14B can be applied to the EL display device with the structure in which light from the EL layer is emitted to the substrate side, as shown in FIG. 9A.

A mounting method for the display device as described here is one example, and thus the display device can be suitably integrated in accordance with the configuration of the display device.

Embodiment 7

Figure 17:
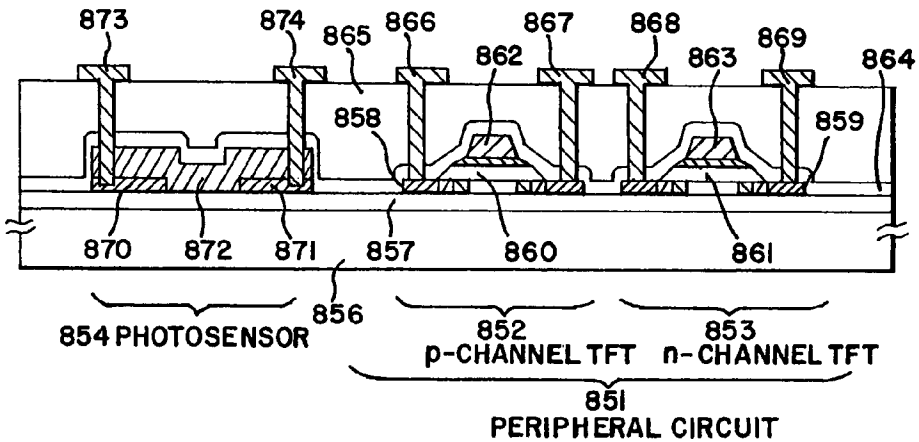
FIG. 17 is a cross sectional view of the photosensor in which is integrally formed on a substrate.

FIG. 17 shows one example in the case where the photosensor is integrally formed with the substrate in which elements such as TFTs are formed. A p-channel TFT 852 and an n-channel TFT 853 in a peripheral circuit 851 are manufactured as in Embodiment 2. A blocking layer 857 is formed on a substrate 856, and then semiconductor films 858 and 859 gate insulating films 860 and 861, and gate electrodes 862 and 863 are formed. The gate insulating films 860 and 861 are processed by etching so as to expose the surfaces of the semiconductor films 858 and 859 outside the gate electrodes 862 and 863. A passivation film 864 and an interlayer insulating film 865 made of an organic resin material are formed on or over the gate electrodes 862 and 863, and then source and drain electrodes 866 to 869 are formed.

Details with respect to, a channel forming region and a p-type impurity region, which are formed in the semiconductor film 858 of the p-channel TFT 852, and a channel forming region and an n-type impurity region, which are formed in the semiconductor film 859 of the n-channel TFT 853, are the same as the p-channel TFT 453 and the n-channel TFT 454, as shown in FIG. 6B in Embodiment 2.

On the other hand, a photosensor 854 is manufactured by the same process as in those TFTs. A p-type semiconductor region 870 and an n-type semiconductor region 871 are formed using the same crystalline semiconductor as in the semiconductor film 858 and 859. A p-type or n-type impurity element is introduced simultaneously when the impurity regions of the TFT are formed. An amorphous silicon film 872 is formed at a thickness of 500 to 1000 nm so as to overlap with the impurity semiconductor regions. It is desirable that the amorphous silicon film 872 is an intrinsic semiconductor, and thus a pin junction is formed. Reference numeral 873 denotes an electrode which is in contact with the p-type semiconductor region 870, and 874 denotes an electrode which is in contact with the n-type semiconductor region 871.

Light can be made incident into the photosensor 854 from the side of the substrate 856. Also, the light can be made incident into the photosensor 854 from the side of the surface that the amorphous silicon film 872 is formed. Thus, an incorporation method for a device body, as described in Embodiment 6, that is, a method of FIG. 14A or 14B can be used.

In this embodiment, the TFT is shown using the structure of the top gate type as described in Embodiment 2. However, the photosensor of this embodiment can be also combined with the inverse stagger type TFT as described in Embodiment 3. Thus, the display device in which such a photosensor is formed can be applied to the liquid crystal display device and the EL display device.

Embodiment 8

The active matrix type display device of the present invention can be used to various electronic equipment. The following can be given as such electronic equipment: a video camera, a digital camera, a projector (rear type or front type), a head-mounted display (goggle type display), a car navigation system, a car stereo, a personal computer, and a portable information terminal (such as a mobile computer, a portable telephone or an electronic book). Examples of these are shown in FIGS. 18 and 19.

Figure 18A:
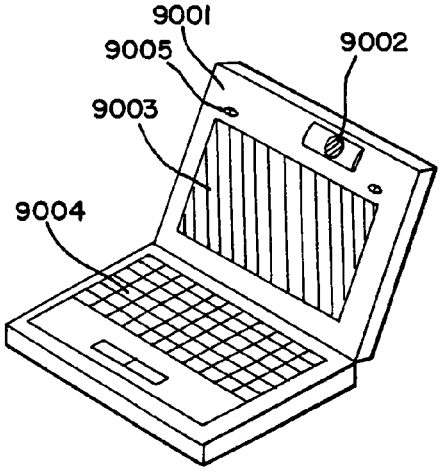
FIGS. 18A to 18F show examples of an electronic device into which the display device of the present invention is incorporated.

FIG. 18A is a personal computer, and it includes a main body 9001, an image input portion 9002, a display portion 9003, and a keyboard 9004. The present invention can be applied to the display portion 9003. The brightness of the display device 9003 can be controlled corresponding to surrounding brightness by the photosensor which is mounted in the light receive portion 9005.

Figure 18B:
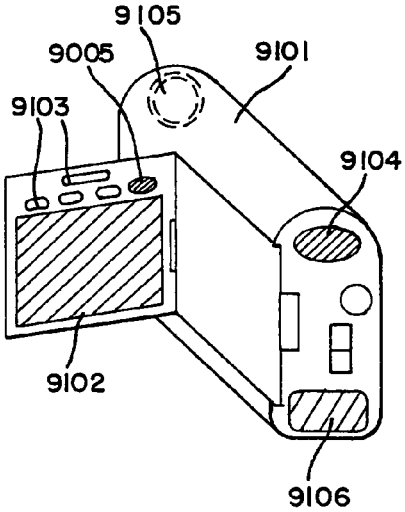

FIG. 18B is a video camera, and it includes a main body 9101, a display portion 9102, an audio input portion 9104, operation switches 9103, a battery 9106, and an image receiving portion 9105. The present invention can be applied to the display portion 9102. The brightness of the display device 9102 can be controlled corresponding to surrounding brightness by the photosensor which is mounted in the light receive portion 9107.

Figure 18C:
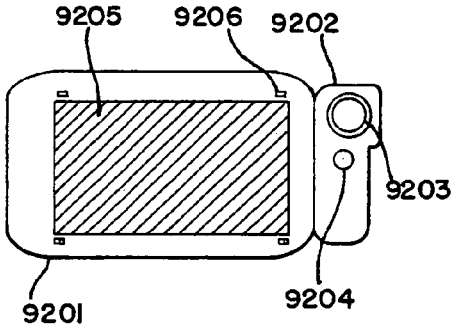

FIG. 18C is a mobile computer or a PDA (personal digital assistant), and it includes a main body 9201, a camera portion 9202, an image receiving portion 9203, operation switches 9204, and a display portion 9205. The present invention can be applied to the display portion 9205. The brightness of the display device 9205 can be controlled corresponding to surrounding brightness by the photosensor which is mounted in the light receive portion 9206.

Figure 18D:
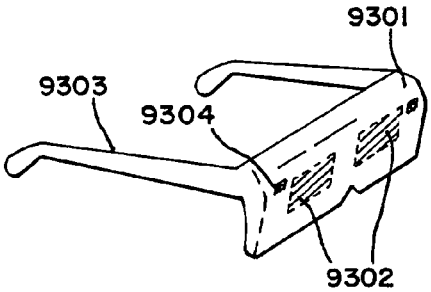

FIG. 18D is a goggle type display, and it includes a main body 9301, a display portion 9302 and an arm portion 9303. The present invention can be applied to the display portion 9302. The brightness of the display device 9302 can be controlled corresponding to surrounding brightness by the photosensor which is mounted in the light receive portion 9304.

Figure 18E:
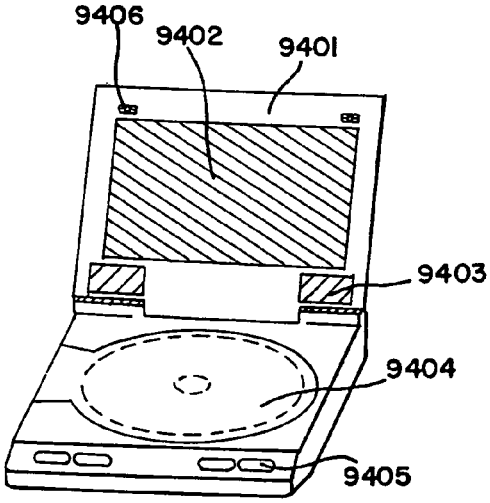

FIG. 18E is a player that uses a recording medium on which a program is recorded (hereafter referred to as a recording medium), and the player includes a main body 9401, a display portion 9402, a speaker portion 9403, a recording medium 9404, and operation switches 1223. Note that this player uses a DVD (digital versatile disk) or a CD such as a recording medium, and the appreciation of music, the appreciation of film, game playing and the Internet can be performed. The present invention can be applied to the display portion 9402. The brightness of the display device 9402 can be controlled corresponding to surrounding brightness by the photosensor which is mounted in the light receive portion 9406.

Figure 18F:
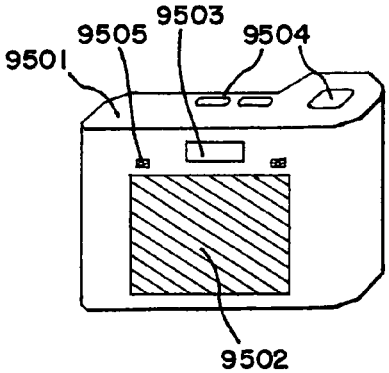

FIG. 18F is a digital camera, and it includes a main body 9501, a display portion 9502, an eyepiece portion 9503, operation switches 9504, and an image receiving portion (not shown in the figure). The present invention can be applied to the display device 9502. The brightness of the display device 9502 can be controlled corresponding to surrounding brightness by the photosensor which is mounted in the light receive portion 9505.

Figure 19A:
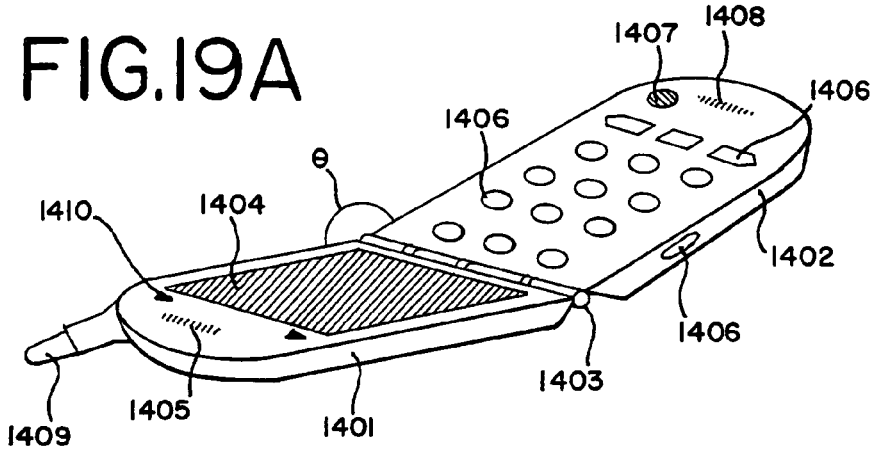
FIGS. 19A to 19C show examples of an electronic device into which the display device of the present invention is incorporated.

FIG. 19A is a portable telephone, and it includes a display panel 1401, an operation panel 1402, a connecting portion 1403, a display device 1404, an audio output portion 1405, an operation key 1406, a power source switch 1407, an audio input portion 1408 and an antenna 1409. The present invention can be applied to the display device 1404. The brightness of the display device 1404 can be controlled corresponding to surrounding brightness by the photosensor which is mounted in the light receive portion 1410.

Figure 19B:
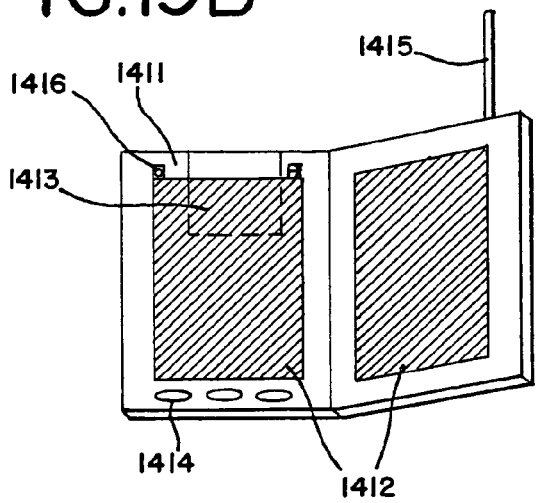

FIG. 19B is a portable book (electronic book), and it includes a main body 1411, display device 1412, a recording medium 1413, operation switches 1414, and an antenna 1415. The present invention can be applied to the display portion 1412. The brightness of the display device 1412 can be controlled corresponding to surrounding brightness by the photosensor which is mounted in the light receive portion 1416.

Figure 19C:
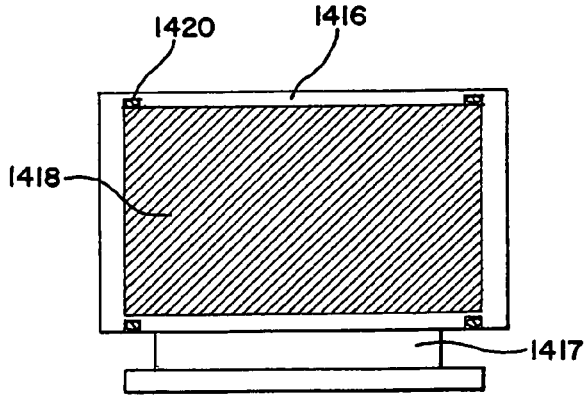

FIG. 19C is a television, and it includes a main body 1416, a support stand 1417, and a display device 1418. The present invention can be applied to the display portion 1418. The brightness of the display device 1418 can be controlled corresponding to surrounding brightness by the photosensor which is mounted in the light receive portion 1420. The television of the present invention is advantageous for a large size screen in particular, and is advantageous for a display equal to or greater than 10 inches (especially equal to or greater than 30 inches) in the opposite angle.

The applicable range of the present invention is thus extremely wide, and it is possible to apply the present invention to electronic equipment in all fields.

The display device of the present invention can control a light emitting luminance of the display device by detecting the brightness of the surrounding using the photosensor. A luminance of an image displayed in the pixel portion of the display device is controlled. That is, when the surrounding is bright, the luminance is increased. On the other hand, when the surrounding is dark, the luminance is decreased. Thus, an image display that viewing is easy to a user can be provided. Also, low consumption power of an electronic device with the display device can be realized.

What is claimed is:

1. A method of manufacturing a display device comprising:

forming a pixel portion comprising a thin film transistor over a first surface of a first substrate;

forming a photosensor having a first surface where a photoelectric conversion layer is formed;

mounting the photosensor over the first substrate opposing the first surface of the photosensor to the first surface of the first substrate with a resin including a conductive particle so that the photosensor does not overlap with the pixel portion;

forming an opposing electrode over a second substrate;

mounting a third substrate comprising a circuit on an opposite surface to the first surface of the first substrate, and bonding the second substrate to the first substrate with a sealing member.

2. A method of manufacturing a display device according to claim 1, wherein at least a pixel electrode, a liquid crystal layer, and the opposing electrode are formed between the first substrate and the second substrate.

3. A method of manufacturing a display device according to claim 1, wherein at least a pixel electrode and a light emitting layer are formed between the first substrate and the second substrate.

4. A method of manufacturing a display device according to claim 1, wherein the photosensor has a photoelectric conversion layer comprising amorphous silicon.

5. A method of manufacturing a display device according to claim 1, wherein the display device is incorporated into an electronic equipment selected from the group consisting of a video camera, a digital camera, a projector, a head-mounted display, a car navigation system, a car stereo, a personal computer, a portable telephone and a portable information terminal.

6. A method of manufacturing a display device according to claim 1, wherein the photosensor is electrically connected to a circuit over the first substrate.

7. A method of manufacturing a display device according to claim 1, further comprising:

forming a circuit for processing a brightness of a surrounding detected by the photosensor;

forming a circuit for changing an amplitude of an image signal based on an output of the photosensor; and forming a circuit for controlling a luminance of a pixel in the pixel portion based on the changed image signal.

8. A method of manufacturing a display device comprising:

forming a pixel portion, a driver circuit for driving the pixel portion, and a control circuit for controlling a brightness of the pixel portion over a first surface of a first substrate, each of the pixel portion, the driver circuit and the control circuit comprising a thin film transistor;

forming a photosensor having a first surface where a photoelectric conversion layer is formed;

mounting the photosensor over the first substrate opposing the first surface of the photosensor to the first surface of the first substrate with a resin including a conductive particle to electrically connect the at least one of the plurality of photosensors to the control circuit so that the photosensor does not overlap with the pixel portion;

forming an opposing electrode over a second substrate;

mounting a third substrate comprising a circuit on an opposite surface to the first surface of the first substrate, and bonding the second substrate to the first substrate with a sealing member.

9. A method of manufacturing a display device according to claim 8, wherein at least a pixel electrode, a liquid crystal layer, and the opposing electrode are formed between the first substrate and the second substrate.

10. A method of manufacturing a display device according to claim 8, wherein at least a pixel electrode and a light emitting layer are formed between the first substrate and the second substrate.

11. A method of manufacturing a display device according to claim 8, wherein the photosensor has a photoelectric conversion layer comprising amorphous silicon.

12. A method of manufacturing a display device according to claim 8, wherein the display device is incorporated into an electronic equipment selected from the group consisting of a video camera, a digital camera, a projector, a head-mounted display, a car navigation system, a car stereo, a personal computer, a portable telephone and a portable information terminal.

13. A method of manufacturing a display device according to claim 8, further comprising:

forming a circuit for processing a signal of a brightness of a surrounding detected by the photosensor; and forming a circuit for changing an amplitude of an image signal based on an output of the photosensor.

* * * * *